United States Patent [19]

Komori et al.

[11] 4,098,551

[45] Jul. 4, 1978

[54] BOTH SIDE COPYING MACHINE

[75] Inventors: Shigehiro Komori, Yokohama; Kimiaki Hayakawa, Tokyo; Hiroshi Nitanda, Tokyo; Tsuneki Inuzuka, Machida, all of Japan

[73] Assignee: Canon Kabushiki Kaisha, Tokyo, Japan

[21] Appl. No.: 656,631

[22] Filed: Feb. 9, 1976

[30] Foreign Application Priority Data

| | | | |
|---|---|---|---|
| Feb. 13, 1975 | [JP] | Japan | 50-18134 |
| Feb. 18, 1975 | [JP] | Japan | 50-24559 |
| Apr. 14, 1975 | [JP] | Japan | 50-45080 |
| Dec. 15, 1975 | [JP] | Japan | 50-150022 |

[51] Int. Cl.[2] ..... G03G 15/30

[52] U.S. Cl. ..... 355/3 R; 355/26

[58] Field of Search ..... 355/23–25, 355/26, 3 R, 8; 271/126, 227, 8, 163, 3.1, 146, 210

[56] References Cited

U.S. PATENT DOCUMENTS

| | | | |
|---|---|---|---|
| 3,545,741 | 12/1970 | Porth | 271/146 |
| 3,615,129 | 10/1971 | Drawe et al. | 355/25 |
| 3,768,805 | 10/1973 | Kuksa | 271/126 |
| 3,856,295 | 12/1974 | Looney | 355/24 |
| 3,862,802 | 1/1975 | Till | 355/23 |
| 3,869,202 | 3/1975 | Tabata et al. | 355/23 |
| 3,870,294 | 3/1975 | Donner | 271/3.1 |
| 3,877,696 | 4/1975 | Miciukiewicz | 271/227 |
| 3,980,406 | 9/1976 | Lang | 355/24 |
| 4,017,173 | 4/1977 | Komori et al. | 355/26 X |

FOREIGN PATENT DOCUMENTS

| | | | |
|---|---|---|---|
| 2,402,148 | 7/1974 | Fed. Rep. of Germany | 355/23 |

OTHER PUBLICATIONS

Cralle et al.; "Sheet Alignment Sensing Station"; IBM Tech. Discl. Bull., vol. 17, No. 9, p. 2675; Feb. 1975.

*Primary Examiner*—A. D. Pellinen

*Attorney, Agent, or Firm*—Fitzpatrick, Cella, Harper & Scinto

[57] ABSTRACT

A copying machine capable of copying originals on the front and back faces of each copy medium comprises a photosensitive medium, a charger for electrostatically charging the photosensitive medium, an optical system for projecting an original image upon the photosensitive medium to form an electrostatic latent image thereof, a developing device for developing the latent image into a transferrable image, a transfer device for transferring the transferrable image onto copy mediums, a first feeder for feeding copy mediums for the front-face copying, a reversing mechanism for reversing the copy mediums fed by the first feeder after the image transfer, and a second feeder for temporally stopping the copy mediums, after reversal, on their way to the transfer device and for feeding the reversed copy mediums to the transfer device for back-face copying.

15 Claims, 45 Drawing Figures

BOTH SIDE COPYING MACHINE

BACKGROUND OF THE INVENTION

1. Field of the Invention

This invention relates to a copying machine which is capable of copying on the front and back faces of a copy medium.

2. Description of the Prior Art

Conventional copying machines have generally been of the type which effects copying on one face of each copy medium. However, when a great quantity of copies is to be preserved, the quantity of the copies becomes double that of books or other matter printed on both sides to be copied and this is disadvantageous in terms of the space required to preserve them and the weight of the copies. Also, from the viewpoint of economizing the required material, manpower and running cost, there is a great need for both-face copying machines which are capable of copying on the front and back faces of each copy medium.

For example, several forms of the image transfer type copying machine capable of both-face copying have heretofore been proposed. One of them is such that ordinary copying (image transfer and fixation) is effected on one face of the copy medium (this will hereinafter be called front-face copying and the course involved therefor will be called the front-face copying course), whereafter such copy medium having completed the single-face copying is guided back to the initial feed means or to second feed means, where the copy medium is reversed and again fed into the copying machine to effect similar copying on the back face of the copy medium (this will hereinafter be called back-face copying and the course involved therefor will be called the back-face copying course). This system may be said to be the most practical one in that it involves only one set of copying processes identical with the single-face copying process, which leads to the provision of low-cost and compact copying machines.

The second feed means heretofore employed has been of the same type as the first feed means which is pre-loaded with copy mediums before the copying. It is such that sheets of copy medium are piled on a box-shaped feed table and separated from one another by separator means utilizing separator pawls or the like, and then advanced one by one by delivery means utilizing a rubber roller or a suction port. As such second feed means, there is known one which includes an arrangement of a cassette and a delivery roller.

However, when such second feed means is employed and copy mediums are to be automatically introduced thereinto, difficulties are encountered in properly piling the sheets of copy medium on the feed table and some device for arranging them in good order is required. The device would involve:

(1) Means for keeping the delivery roller retracted from its operative position while copy medium is being introduced, or means for keeping downwardly retracted from the feed table on which copy mediums are piled;

(2) Means for arranging the separator pawls at the opposite sides of the pile of copy mediums after introduced; and (3) Means for aligning (relocating) the piled copy mediums with respect to their direction of movement and to the widthwise direction perpendicular thereto.

The heretofore proposed copying machines which have incorporated these devices have been very complicated in construction or insufficient in function. They have alsio been inconvenient in operability.

SUMMARY OF THE INVENTION

It is an object of the present invention to provide a copying machine which is simple in construction and capable of copying original images on both faces of each copy medium.

It is another object of the present invention to provide such a copying machine which is equipped with second feed means for back-face copying.

It is still another object of the present invention to provide such a copying machine in which copy mediums may be automatically piled on the second feed means and automatically fed therefrom.

It is yet still another object of the present invention to provide such a copying machine in which the second feed means is disposed along the path of reversed copy mediums to copying process means.

It is a further object of the present invention to provide such a copying machine which permits the second feed means to be installed at the position to be occupied by a copy medium discharge tray.

It is a further object of the present invention to provide such a copying machine to which the second feed means may be removably mounted.

It is still a further object of the present invention to provide such a copying machine which permits reversed copy mediums to be temporally piled on the copy medium supporting table and then fed again to the copying process means.

It is a further object of the present invention to provide such a copying machine in which the reversed copy mediums may be temporally blocked against passage, and then liberated and fed again to the copying process means.

It is a further object of the present invention to provide such a copying machine in which the second feed means can serve both for the separation and the feeding of copy mediums with the aid of a pair of mutually reversible rollers.

It is a further object of the present invention to provide such a copying machine which is equipped with a mechanism for preventing lateral offset of copy mediums.

It is a further object of the present invention to provide such a copying machine which is equipped with a mechanism for relocating the copy mediums.

It is a further object of the present invention to provide such a copying machine in which a plurality of image originals may be automatically supplied.

It is a further object of the present invention to provide such a copying machine which permits originals bearing images both on the front and the back surface thereof to be placed on an original carriage at one time to perform both-face copying.

It is a further object of the present invention to provide such a copying machine which permits change-over of the size of the originals bearing images both on the front and the back surfaces thereof placed on the original carriage.

According to the present invention, the second feed means employed is different in type from the first feed means and permits copy mediums to be easily and automatically piled thereon. This second feed means may utilize a pair of rubber rollers or a rubber roller and a friction plate and the copy mediums, when introduced onto a paper feed plate, may be blocked by rotation of the roller and become piled on that plate; in response to a paper feed signal, the rubber roller or rollers start to rotate (in the case of a pair of rubber rollers, one of them is reversely rotated to perform the separating fuction) thus feeding the copy mediums one by one to register roller means. In this case, lateral offset of the copy mediums (namely, offset in the direction perpendicular to the direction of movement of the copy mediums) only have to be corrected to arrange them in good order and, in the direction of movement, the copy mediums may naturally abut against the rubber roller means so as to be prevented from being fed.

A supporting plate for copy mediums may be provided in a portion of the passageway of the copy mediums, so that the copy mediums may be temporally piled on the supporting plate, whereafter they may again be fed by separator means utilizing separator pawls or the like.

Further, in addition to the feed roller or the like, a copy medium blocking member may be employed to temporally block the copy mediums, whereafter the blocking member may be released to feed the copy mediums again.

Details of these will become more fully apparent as the description of embodiments will hereinafter proceed.

Where both-face copying is to be effected on a sheet of copy paper, image originals corresponding to the front and back faces of the copy paper are copied and thus, by using an original carriage having an original supporting surface dimensionally corresponding to double the copy size, two different originals may be placed on the original carriage at a time and copied alternately. This will correspondingly reduce the cumbersomeness involved in placing originals on the carriage (see FIG. 2 of the accompanying drawings).

Such case will further include the following two different situations:

(1) The two-surface originals to be subjected to the both-face copying are separable from each other and may be separately placed on the original carriage at one time; and (2) Like a leaf of an ordinary book, the two-surface originals to be subjected to the both-face copying are unseparable and cannot be placed on the original carriage at the same time.

Even in the second situation mentioned above, if several consecutive pages of a book to be copied (as would be the most usual case), the book may be opened at a desired page and placed on the original carriage with the two spread-over pages resting on the original supporting surface, whereafter the copying may be carried out in the following sequence:

In the first copy cycle, copying is effected on the back face of a first sheet of copy paper;

In the second copy cycle, copying is effected on the front face of a second sheet of copy paper;

A leaf of the book is turned over;

In the third copy cycle, copying is effected on the back face of the second sheet of copy paper;

In the fourth copy cycle, copying is effected on the front face of a third sheet of copy paper;

Another leaf of the book is turned over;

In the fifth copy cycle, copying is effected on the back side of a third copy paper; and so on.

(See FIG. 5 of the accompanying drawings.)

In such a case, the two-surface originals placed on the original supporting surface are copied not on the opposite faces of the same copy sheet but on one face of a first copy sheet and on the other face of a second copy sheet. Nevertheless, even in this case, the two surfaces to be copied are still placed on the original carriage at the same time.

Thus, it is also an object of the present invention to provide a copying machine which has an original supporting surface dimensionally corresponding to two surfaces of a copy size and simply permits both-face copying to be accomplished in accordance with that copy size irrespective of a great variety of available copy sizes and which is highly effective and convenient to operate for the both-face copying.

The invention will become fully apparent from the following detailed description of some embodiments thereof taken in conjunction with the accompanying drawings.

BRIEF DESCRIPTION OF THE DRAWINGS

FIG. 53 is a perspective view corresponding to FIG. 22.

DESCRIPTION OF THE PREFERRED EMBODIMENTS

Figure 1:
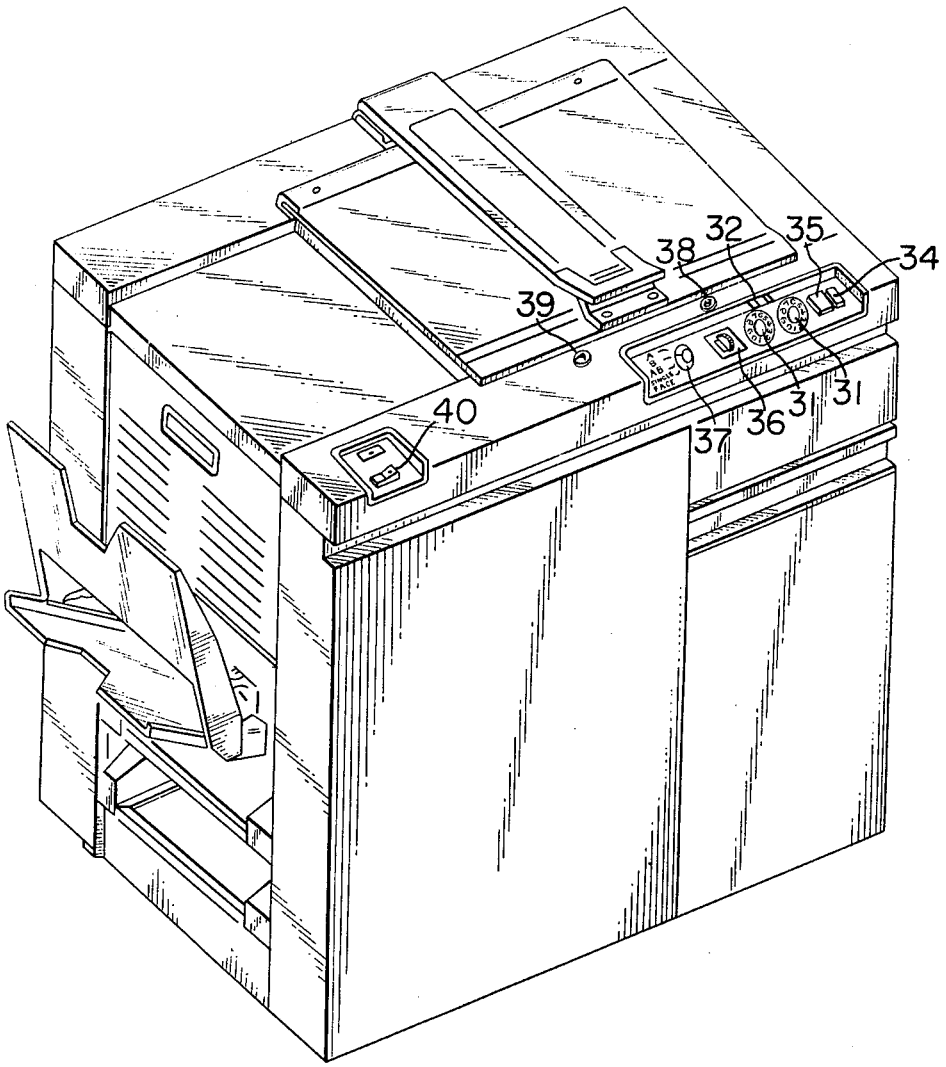
FIG. 1 is a pictorial, perspective view of a copying machine according to either a first or second embodiment of the present invention.

The invention will hereinafter be described with respect to some embodiments of the image transfer type electrophotographic copying machine employing a stationary original carriage which is capable of easily copying even thick originals or three-dimensional originals.

Operation of the Copying Machine

Description will first be made of the operation of the copying machines of the embodiments shown in FIGS. 3, 16 and 31.

An original 3 to be copied is placed on the transparent plate 2 of an original carriage, and an optical system comprises movable mirrors 4 and 5, a lens 7 and stationary mirrors 8 and 9. The original 3 is illuminated by a movable illuminating lamp 6 with the length of the optical path maintained constant by the movable mirror 4 moved with the lamp 6 and the movable mirror 5 moved in the same direction but at half the speed of the mirror 4, and the image of the original is further directed via the stationary mirrors 8 and 9 for slit exposure and focused on a drum 1.

The surface of the drum 1 is provided with a photosensitive medium comprising a photosensitive layer covered with a transparent insulating layer. The photosensitive medium is first charged to the positive polarity by a positive (+) charger 11 supplied with a high voltage current from a high voltage source 10. Next, when the photosensitive medium reaches an exposure section 12, the original 3 on the transparent plate 2 of the original carriage is illuminated by the illuminating lamp 6 and imaged on the drum 1 by the movable mirrors 4, 5, the lens 7 and the stationary mirrors 8, 9. Simultaneously with the exposure to the original image, the photosensitive medium is subjected to AC discharge from an AC discharger 13 which is supplied with a high alternating current from the high voltage source 10.

The photosensitive medium is then subjected to allover exposure by an allover exposure lamp 14 to form an electrostatic latent image on the drum surface, i.e. the photosensitive medium, whereafter it enters a developing device 15.

The electrostatic latent image is developed into a visible image by the dust development technique utilizing a magnetic sleeve.

Subsequently, a sheet of copy paper 17 fed from within a cassette 16 is brought into intimate contact with the drum 1. An image transfer charger 18 supplied with a current from the high voltage source 10 charges the copy paper to the positive polarity to thereby transfer the image on the drum 1 onto the copy paper.

The copy paper with the image so transferred thereto is separated from the drum 1 at a separating section 19 and thence directed to a fixing section 20. On the other hand, the drum surface (photosensitive medium) is cleaned by a blade 21 urged thereagainst for the removal of any residual toner on the drum, whereby the drum may become ready for reuse in another cycle.

Both-Face Copying

Figure 3:
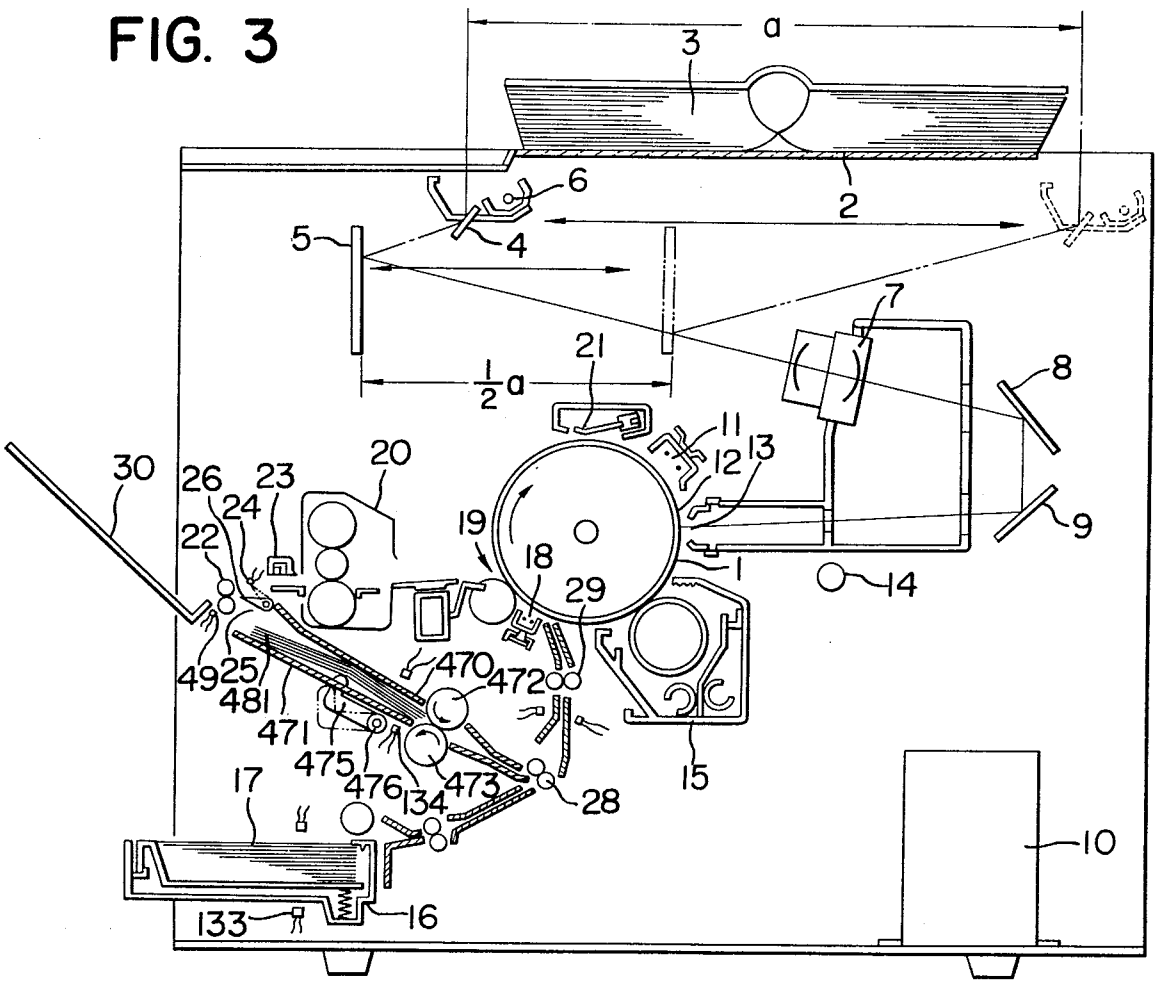
FIG. 3 is a vertical cross-sectional view of a first embodiment of the copying machine according to the present invention.
Figure 16:
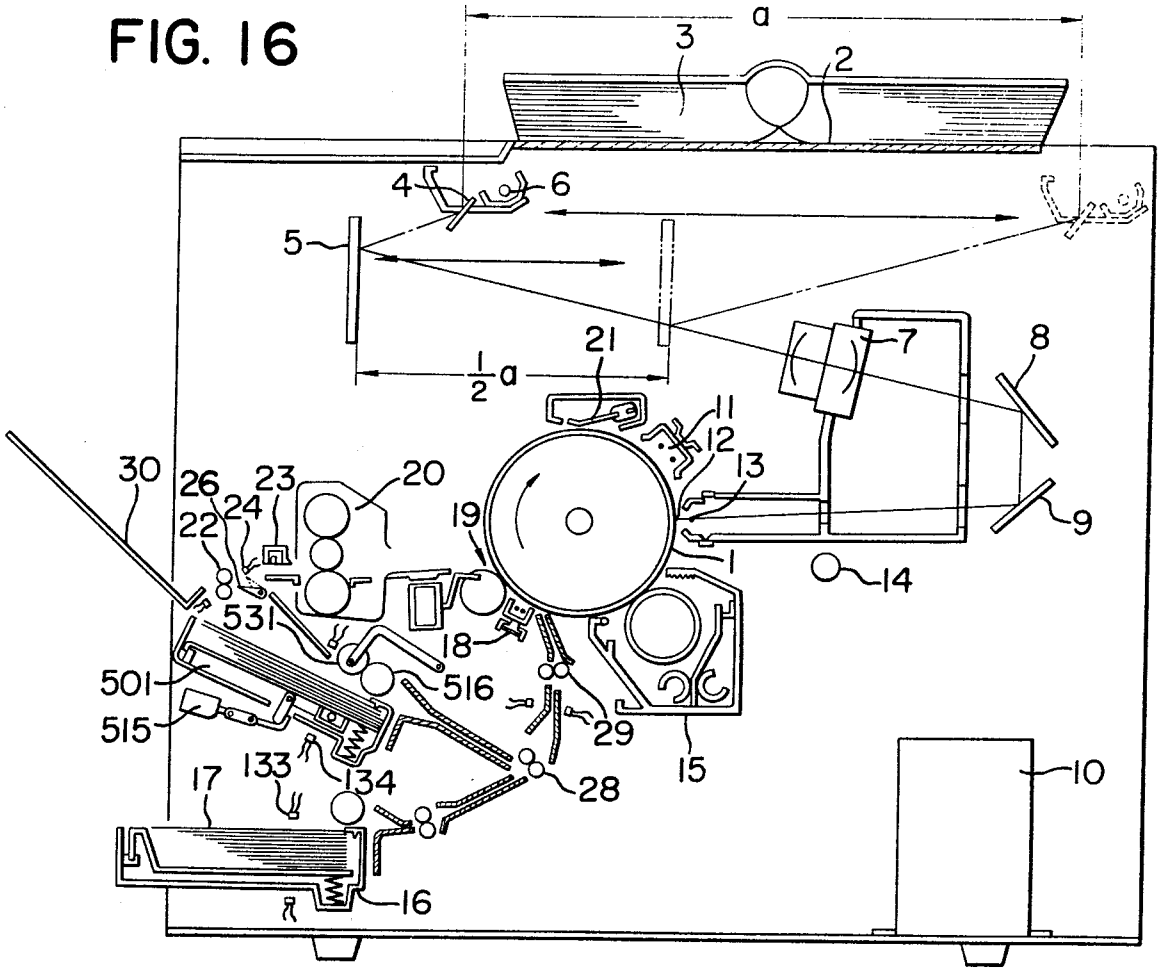
FIG. 16 is a vertical cross-sectional view of the second embodiment of the copying machine according to the present invention.

Reference will now be had to FIGS. 3 and 16 to describe the manner in which copying on both faces of the copy paper is accomplished as a feature of the present invention basically by the above-described construction. The paper conveying system will first be considered. It is designed such that the copy paper 17, after having copied the original image on the front face thereof, is not discharged out of the copying machine but is again directed to the image transfer device for copying the back face of the original. More specifically, for front-face copying, the copy paper is passed through the fixing device 20 and transported by discharge rollers 22 while any excess charge thereon is removed by a discharger 23, whereafter the passage of the trailing end of the copy paper is detected by a light-sensing element 24, whereupon the discharge rollers 22 are reversed in rotational direction to guide the copy paper to a back-face copying passageway 25. Simultaneously with the reversal of the paper discharge rollers, a guide plate 26 is displaced to a position for guiding the copy paper, whereby the copy paper is guided to paper feed means for back-face copying. For multi-copy mode, successive sheets of copy paper may be piled therein.

Subsequently, the back-face copy course is entered and the copy paper is conveyed by rotation of a transport roller 472 and 473 for passage between conveyor roller 28 and again delivered into the image transfer means by a paper feed signal under the control of the register rollers 29. After completion of the image transfer, the copy paper is passed through the fixing means 20 and the discharger 23 and discharged onto the tray 30.

Paper Conveyor System

Figure 31:
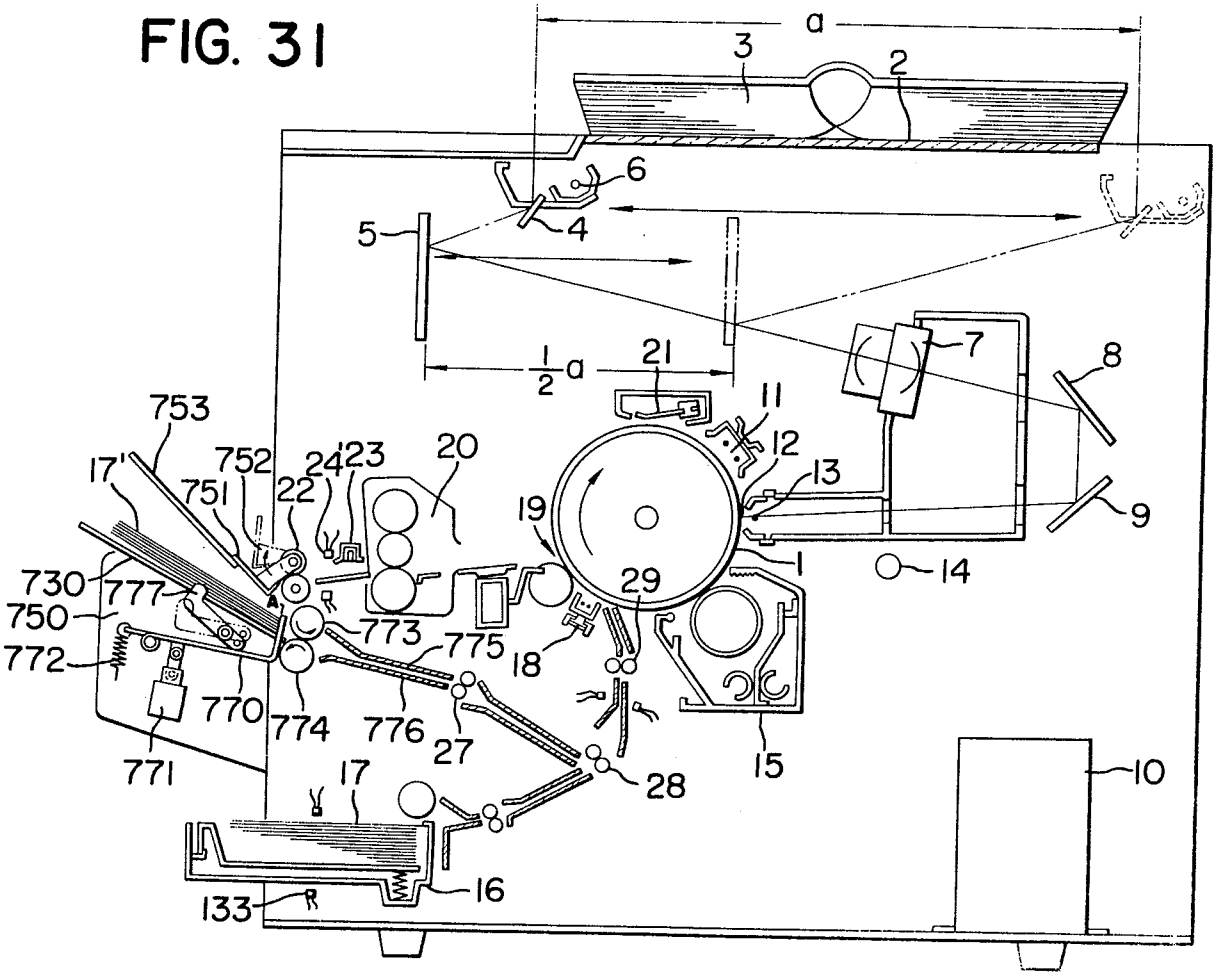
FIG. 31 is a vertical sectional view of the third embodiment of the copying machine according to the present invention.

The paper conveyor system of FIG. 31 will now be considered. The copy paper 17', after having copied the original image on the front face thereof, is discharged into second paper feed means 750 by the discharge rollers 22. A predetermined number of such front-face copies are completed and piled in the second paper feed means 750 and, when they are positively relocated therein by relocating means, the back-face copying course is entered. Sheets of copy paper 17' piled in the second paper feed means 750 are held with their end edges A abutting against a stop plate 770, but the stop plate 770 is released by energization of a solenoid 771 so as to permit the copy sheets 17' to contact paper feed rollers 773, 774, whereafter the copy sheets are one by one fed into between guide plates 775 and 776 by rotation of the feed rollers 773, 774 and transported past rollers 27 and rollers 28 into the image transfer means by a paper feed signal under the control of the register rollers 29. After completion of the image transfer, the copy paper is passed through the fixing means 20 and the discharger 23 and discharged onto the tray 751 by discharge rollers 22. Designated by 24' is a jam detector element for detecting whether or not the copy paper transported from the first or the second paper feed means has been discharged by the discharge rollers 22 without jamming.

Operation of the Optical System

Figure 4:
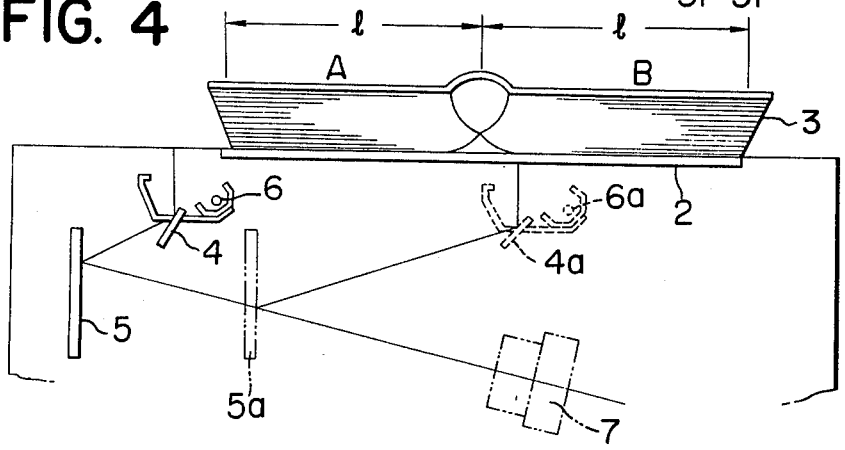
FIGS. 4 and 5 illustrate the relation between the both-face copying and the optical system in each embodiment.
Figure 5:
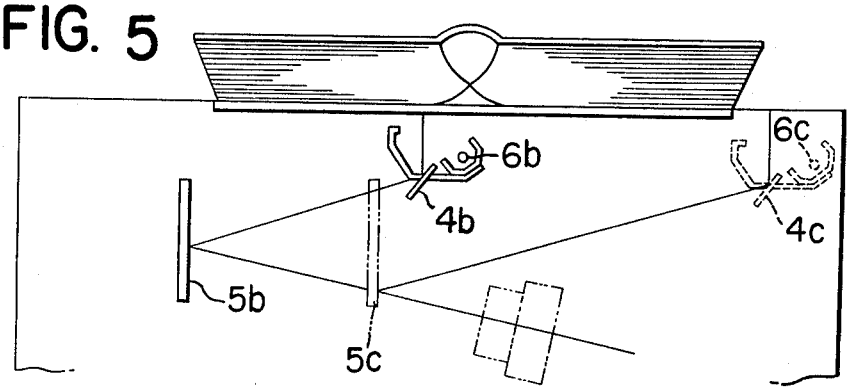

FIGS. 4 and 5 illustrate the operation of the optical system during the both-face copying mode of each embodiment.

The original carriage in the embodiments now under discussion is dimensioned to cover the format A3 size and description will be made with respect to a case where a book of format A3 is copied on both faces of A4 size copy paper.

Figure 6A:
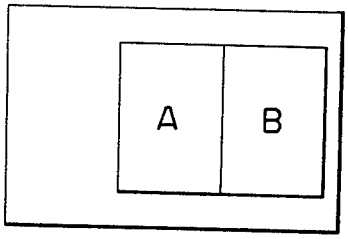
FIGS. 6*a* to 6*c* illustrate the manner in which originals are placed on the original carriage in each embodiment.
Figure 6B:
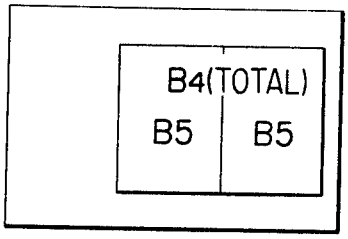
Figure 6C:
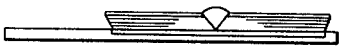

The original supporting surface is divided into surfaces A and B (each being of A4 size), as shown in FIG. 6(*a*) so that two surfaces of A4 size to be copied may be placed on the original carriage at the same time as shown in FIG. 6. The same applies to other sizes, such as B4 size, as shown in FIG. 6(*c*). It may thus be said the middle of the carriage is a dividing line along which the original supporting surface is divided into the two surfaces A and B.

The surface-A copying will now be described by reference to FIG. 4. As is the case with the common copying machine, the illuminating means and mirror 6 and 4 of the optical system have their start positions lying immediately before the surface A of the original carriage and are started by a start signal which controls the photosensitive drum, whereafter they enter the surface-A illuminating stroke. Upon completion of the illumination, the mirrors and illuminating means 4 and 6 come to a halt at 4*a* and 6*a*, respectively.

At the same time, the movable mirror 5 is also moved to its position 5*a*.

The surface-B copying will now be considered by reference to FIG. 5. The illuminating meamns and mirror 6 and 4 have their start position lying immediately before the surface B of the original carriage, namely, at 6*b* and 4*b*, respectively, and when the surface-B illumination is completed in the same manner as in the surface-A copying, the optical system comes to a halt at 4*c*, 5*c*, 6*c*.

The length of the surface-A illuminating stroke (as well as the surface-B illuminating stroke) is the length l of the surface A plus the slit width plus the allowances for the starting and stoppage of the movement. Thus, the optical system comes to a halt at the stop position 4*a*, 5*a*, 6*a* as indicated in FIG. 4. Therefore, in order to shift from the surface-A copying to the surface-B copying, the optical system 4, 5, 6 must be moved back and adjusted to the surface-B copying start position 4*b*, 5*b*, 6*b*.

Likewise, in order to shift from the surface-B copying back to the surface-A copying, the optical system must be adjusted to its start position as indicated in FIGS. 3, 16 or 31.

A feature of the present embodiment is not only that two surfaces to be copied can be copied without the need to relocate the original each time, but that both-face copying can be easily done for every sheet of copy paper with the front-face copying course being automatically followed by the back-face copying course.

Further, by designating the surface A as the original supporting surface for the front-face copying and the surface B as the original supporting surface for the back-face copying, the following advantageous features may be additionally provided.

A signal for discriminating between the two strokes may be produced as by utilizing the difference between the start position of the optical system for surface-A copying and that for surface-B copying, whereby it becomes possible to carry out the following:

In case of the surface-A copying:

The fact of the front-face copying is first indicated. Further, after completion of the front-face copying, indication or alarm means is provided so that the copy paper may be set to a position in which it is ready to be fed for the back-face copying.

Or, further automation is imparted to set the copy paper to a position in which it is ready to be fed for the back-face copying, after completion of the front-face copying. More specifically, the copy paper having completed the front-face copying is not discharged from the discharge rollers but reversed to the position in which it is ready to be fed for the back-face copying, or alternatively the copy paper is discharged into the second paper feed means 750, where it is readjusted to the position in which it is ready to be fed for the back-face copying.

In case of the surface-B copying:

The fact of the back-face copying is first indicated. Further, after completion of the back-face copying, an indication or alarm is given so that the copy paper may be discharged onto the tray, or further positive automation is imparted to discharge the copy paper onto the tray.

In this manner, the mode indication and the operation of the copying machine may be changed over between the surface-A copying and the surface-B copying to thereby enhance the operability.

Figure 7A:
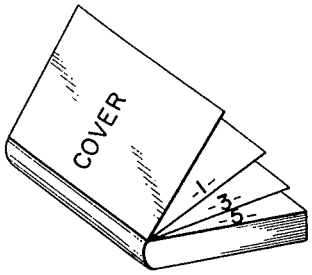
FIGS. 7*a* to 7*d* shows the left-hand and the right-hand binding of books or the like and illustrate the manner in which such books are placed on the original carriage.
Figure 7B:
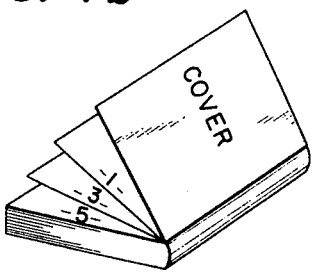
Figure 7C:
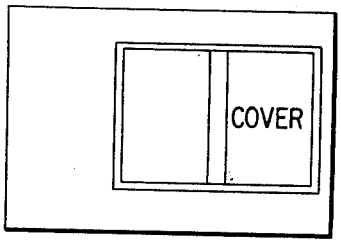
Figure 7D:
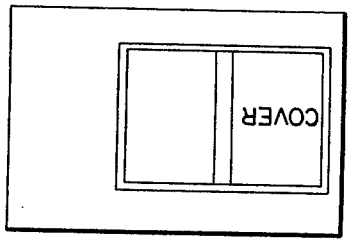

Books are usually bound in two different fashions, namely, right-hand binding and left-hand binding, as shown in FIGS. 7*a* and 7*b*, but it is usual with either case that the front surface of each leaf is an odd-numbered page and the back surface is an even-numbered page. Therefore, if any book is placed on the original carriage with an odd-numbered page corresponding to the surface A and an even-numbered page corresponding to the surface B, both-face copying may be exactly accomplished irrespective of the right-hand or the left-hand binding. As seen in FIGS. 7(*c*) and 7(*d*), the book is positioned depending on whether it is bound on the left-hand side (FIGS. 7*a* and *b*) or on the right-hand side (FIGS. 7*c* and *d*). This also forms an advantage that a convenient indication for the operation taking place can be given by designating the surfaces A and B as the front-face copying and the back-face copying, respectively.

Also, if the copying is effected in such a sequence that the surface-A copying is followed by the surface-B copying, namely, the front-face copying is followed by the back-face copying, then a great convenience will be experienced in the case of the present embodiment in that sheets of copy paper already printed on both faces thereof are piled on the tray with their back faces facing upwardly, that is, in the order of page numbers.

Although the invention has hitherto been described with respect to the stationary original carriage type copying machine, it is in no way limited thereto but is applicable to the reciprocable original carriage type copying machine, in which case the original carriage may be made to correspond to the surfaces A and B and moved reciprocally, and the invention is not restricted to the image transfer type but applicable to any other type of copying machine such as, for example, the electrofax type machine or the like.

Passage of Copy Paper for the Back-Face Copying

Figure 8:
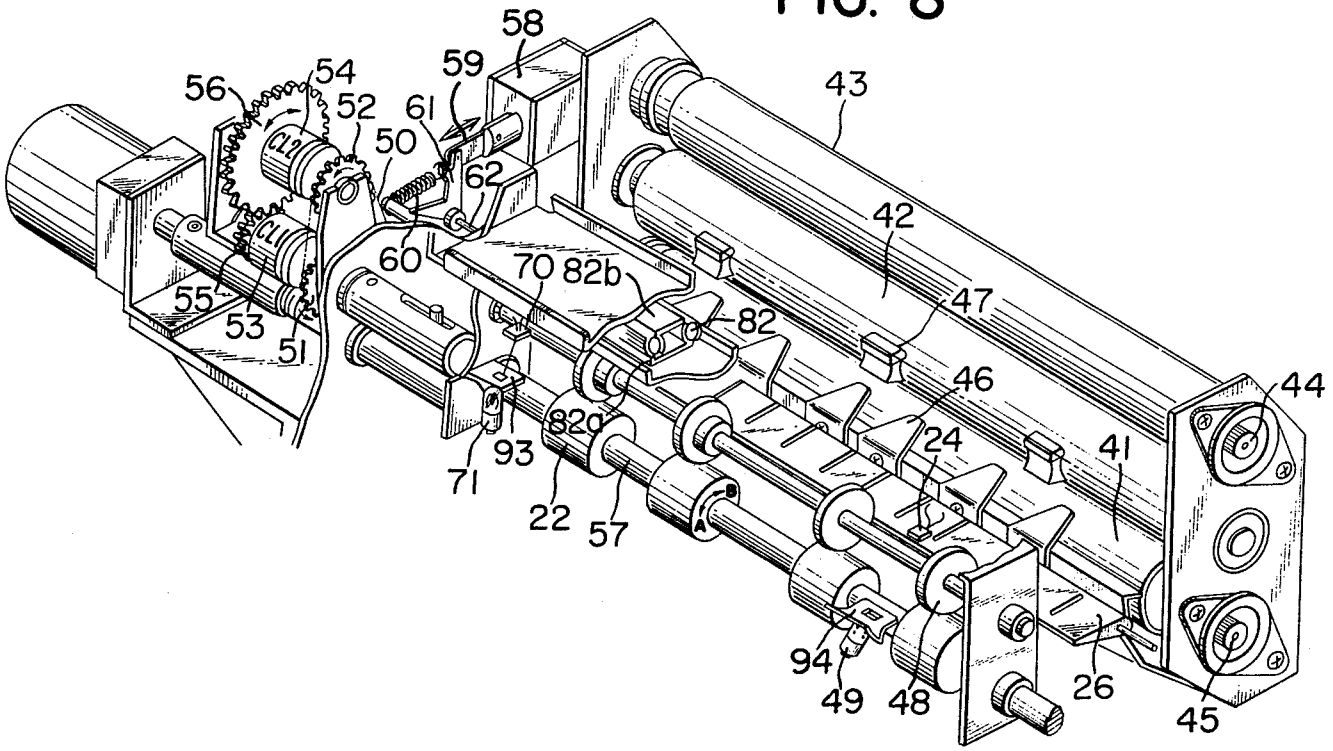
FIG. 8 is a perspective view of the mechanism for back-face copying in each of the first and the second embodiments.
Figure 9:
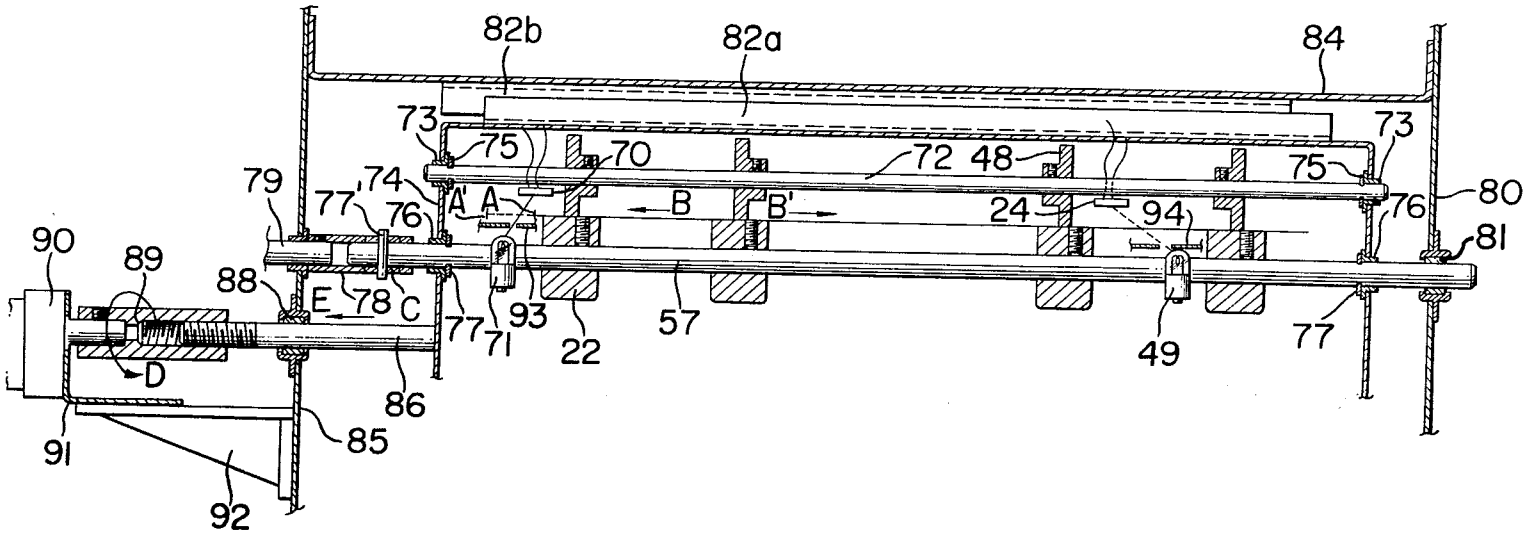
FIG. 9 illustrates means for correcting lateral offset of copy mediums in the case of back-face copying.
Figure 10:
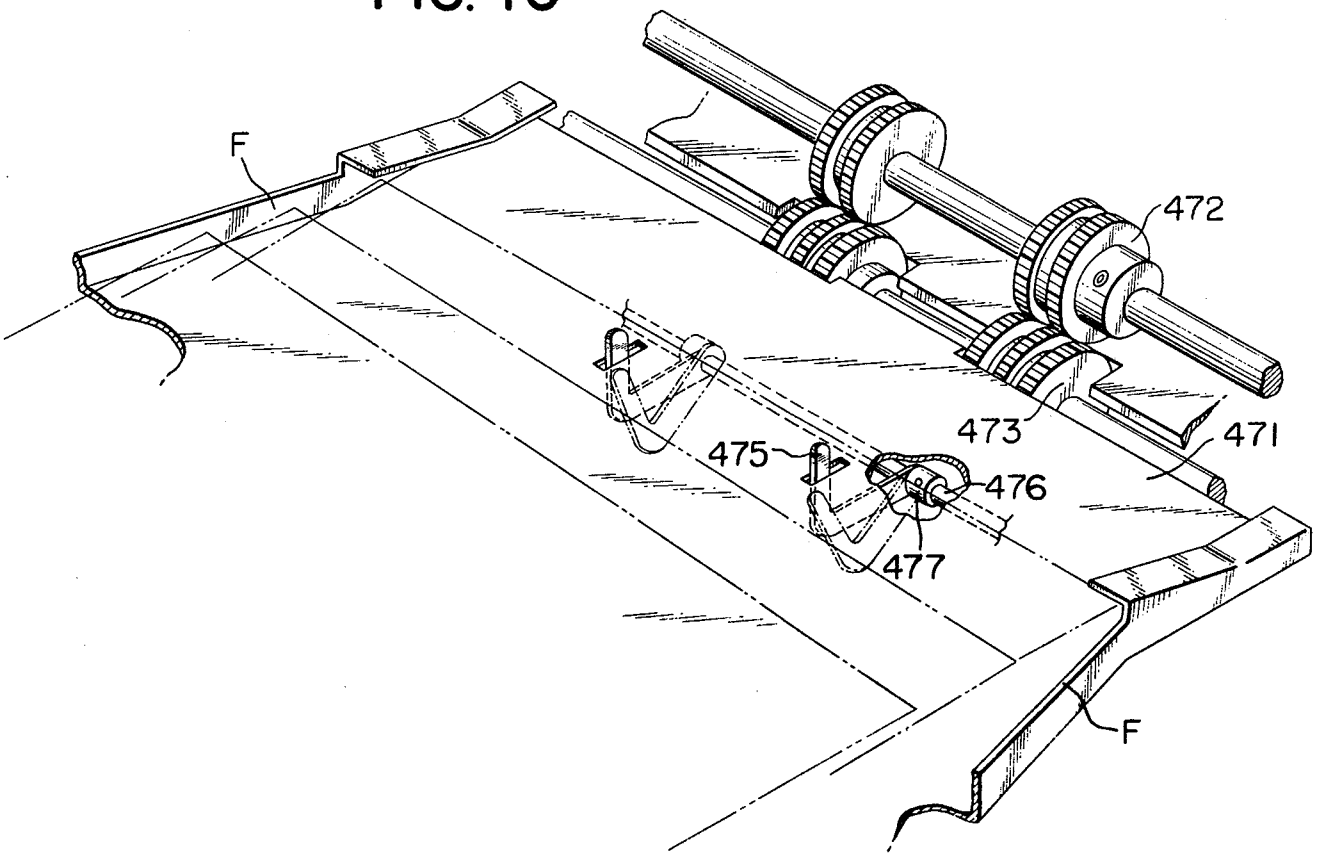
FIG. 10 is a perspective view of the paper feed stock section in the first embodiment.

Reference will now be had to FIGS. 8 and 9 to describe in detail the operation of the mechanism whereby, in FIGS. 3 and 10, the copy paper which, during front-face copying, is passed through the fixing device 20 and conveyed by the discharge rollers 22 while any excess charge is removed by the discharger 23 and, has the passage of the trailing end edge thereof detected by the light-sensing element 24 and guided to the back-face copying passageway 25 by the reversal of the discharge rollers 22. First, the fixing device 20 employs the so-called hot roller fixing method and includes a heater 45 at the core thereof, and a heating roller 41 rotatable independently of the heater and having the surface thereof covered with silicone rubber. A heating roller 42, which is a fixing roller, may be supplied with heat by a pressing roller 43 having a heater 44 at the core thereof and rotatable independently of the fixing roller. The copy paper with an image transferred thereto is nipped between the heating roller 41 and the fixing roller 42 for fixation of the transferred image and guided to the discharge rollers 22. Scrapers 46 and separator pawls 47 are provided to prevent the so fixed copy paper from coiling around the fixing roller 42 and the heating roller 41.

Normal and Reverse Rotation of Discharge Rollers

Description will now be made of how normal and reverse rotations of the discharge rollers 22 in FIGS. 3 and 16 are accomplished.

When the discharge rollers 22 are rotating in the direction of arrow A, an electromagnetic clutch 53 is energized while an electromagnetic clutch 54 is deenergized, and the rotation of a sprocket 51 rotated by a chain 50 in the direction of the arrow independently of the rotation of a discharge roller shaft 57 is transmitted through the electromagnetic clutch 53 to the discharge roller shaft 57. When rotation of the discharge roller 22 is reversed to the direction of arrow B, the electromagnetic clutch 53 is deenergized while the electromagnetic clutch 54 is energized, and the rotation of the sprocket 52 is rotated by the chain 50 in the direction of arrow is transmitted through the electromagnetic clutch 54 to a gear 56 and further to a gear 55 secured to the discharge roller shaft 57, which in turn rotates the discharge roller 22 in the direction of arrow B.

Now, the copy paper passed through the fixing device is conveyed by the discharge rollers 22 and follower discharge rollers 48. When the passage of the trailing end of the copy paper is electrically detected by a paper trailing end detecting mechanism comprising the light-sensing element 24 and the lamp 49 as light source, the resulting electrical signal deenergizes the electromagnetic clutch 53 which has so far been energized, whereby the paper is temporally stopped from moving. However, it cannot positively be said that the copy paper having come to the discharge roller portion is never laterally offset with respect to its direction of movement and therefore, it is necessary to check up the presence of such lateral offset and to correct the offset before the back-face copying course is entered.

Correction of Lateral Offset of Copy Paper

For the reason set forth above, a lateral offset correcting mechanism is shown in FIG. 8 and 9.

First, the electromagnetic clutch 53 is deenergized to temporally stop the paper from moving, as already described. In FIG. 9, the paper must first be displaced in the direction of arrow B until one side edge A of the paper comes onto the optical axis passing between a lamp 71 and a CdS cell 70, as shown in order to correct the lateral offset of the paper with respect to the direction of movement thereof by the CdS cell 70 and lamp 71. Conversely, when the side edge of the paper lies at A′ as indicated by a dotted line, the paper must be displaced in the direction of arrow B′ until said side edge of the paper comes onto the optical axis passing between the CdS cell 70 and the lamp 71, whereupon the paper may be stopped from moving and thus, the lateral offset of the paper may be corrected.

Lateral Offset Correcting Mechanism

By reference to FIG. 9, the mechanism for correcting such lateral offset of the paper will now be discussed.

Designated by 22 are the discharge rollers and 48 their follower discharge rollers. The follower discharge rollers 48 are secured by screws to a follower roller mounting shaft 72 which is rotatably journalled by bearings 73. The bearings 73 are secured to a discharge roller mounting base plate 74, and the shaft 72 is located by clamp washers 75 against movement in thrust direction. On the other hand, the discharge rollers 22 are secured by screws to the discharge roller shaft 57 which is rotatably journalled by bearings 76. The shaft 57 is located by clamp washers 77 for movement in thrust direction with respect to the mounting base plate 74. A pin 771 is studded in the shaft 57 and engaged in a slot C for movement in thrust direction, the shaft being formed in a portion of a collar 78 movable in thrust direction with respect to the shaft 57. The collar 78 is rigidly secured to a shaft 79 as by screws. The shaft 79 is in turn secured to the gear 55 (FIG. 8). The other end of the shaft 57 is journalled by a slide bearing 81 for movement in thrust direction, the slide bearing being secured to a side plate 80 of the machine body. In its lower portion, the mounting base plate 74 is securely connected to a portion **82*a* of a slide rail, which is slidably connected to another slide rail 82*b* by steel balls 82. The slide rail 82*b* is secured to a mounting plate 84 which is in turn secured to the opposite side plates 80 and 85 of the machine body. A shaft 86 is, on the one hand, caulked or otherwise secured to the mounting plate 74 and on the other hand, held for movement in thrust direction by a slide bearing 88 secured to the side plate 85 of the machine body. The other end portion of the shaft 86 is externally threaded. A collar 89 having an internally threaded portion engaged with the thread of the shaft 86 has one end secured to the shaft of a reversible motor 90. The reversible motor 90 is fixed to a motor mounting plate 91, which is in turn secured to a base plate 92 mounted on the side plate 85 of the machine body. Thus, rotation of the collar 89 in the direction of arrow D may cause movement of the shaft 86** in the direction of arrow E.

The lamp 71 and CdS cell 70 and a slit for stopping the optical axis therebetween to ensure the side edge of the paper to come to a halt exactly at a predetermined position are all secured to the side plate 85 of the machine body as by a mounting plate.

A slit 94 is also provided for stopping the optical axis between the CdS cell 24 and the lamp 49 which are secured to the side plate 80 of the machine body, and the slit 94 is secured to the mounting base plate 74.

Operation of the Correcting Mechanism

Operation of the correcting mechanism will now be explained. In FIG. 9, when the movement of the paper is stopped with one side edge thereof lying at A, the paper side edge detecting mechanism provided by the CdS cell 70 and lamp 71 acts to operate the reversible motor 90 so as to rotate the collar 89 in the direction of arrow D and thereby displace the shaft 86 in the direction of arrow E till the moment when that side edge of the paper crosses the optical axis between the lamp 71 and the CdS cell 70, whereupon the motor stops its operation in a moment.

On the other hand, when the paper comes to a halt with said one side edge lying at the dotted-line position, A', in FIG. 9 (in other words, crossing the optical axis between the lamp 71 and the CdS cell 70), the paper side edge detecting mechanism provided by the CdS cell 70 and lamp 71 again operates the reversible motor to rotate the collar 89 now in the direction opposite to the direction D and thereby displace the shaft 86 in the direction opposite to the direction of arrow E till the moment when the side edge crosses the optical axis between the lamp 71 and the CdS 70, whereupon the motor stops its operation in a moment.

When the side edge of the paper thus assumes its regular position, the electromagnetic clutch 54 so far deenergized is energized to cause reverse rotation of the discharge rollers which have nipped therebetween the trailing end of the copy paper. Simultaneously therewith, the rocking lever 61 (FIG. 8) is usually pulled by the spring 60 and accordingly, the guide plate 26 (secured to the shaft 52 to which the rocking lever 61 is also secured) is held at the solid-line position as indicated in FIG. 3. Upon energization of the solenoid 58, the guide plate 26 is displaced by the solenoid operating arm 59 about the shaft 62 to the position as indicated by a dotted line in FIG. 3, so that the copy paper is guided into the back-face copying passageway 25 and stopped near the register rollers 29 by the conveyor rollers 27 and 28.

After the paper has fully passed through the discharge roller portion and until the light from the lamp 49 impinges on the CdS cell 24 or until the slit 94 returns to its regular position (the position shown in FIG. 9), the reversible motor continues to rotate, for example, in the direction opposite to the direction E which is the direction for initially detecting the paper side edge, and the motor stops at the moment when the light from the lamp 49 is detected by the CdS cell 24.

The above-described correction of the lateral offset of the paper necessarily leads to the obviation of any lateral offset of the copy paper with respect to the image original.

Second Feed Means

Reference will now be had to another embodiment shown in FIGS. 27, 31, 32, 33 and 34 to describe the operation of the mechanism whereby, in FIG. 31, the copy paper which, during the front-face copying, is passed through the fixing means 20 and conveyed by the discharge rollers 22 while any excess charge in the paper is removed by the discharger 23, may be discharged into the second paper feed means 750 to shift to the back-face copying course.

Before the back-face copying course is entered, sheets of copy paper 17' piled in the second paper feed means 750 are relocated to prevent their lateral offset with respect to the direction of movement, whereby the copy paper may positively pass through the back-face copying course.

Figure 32:
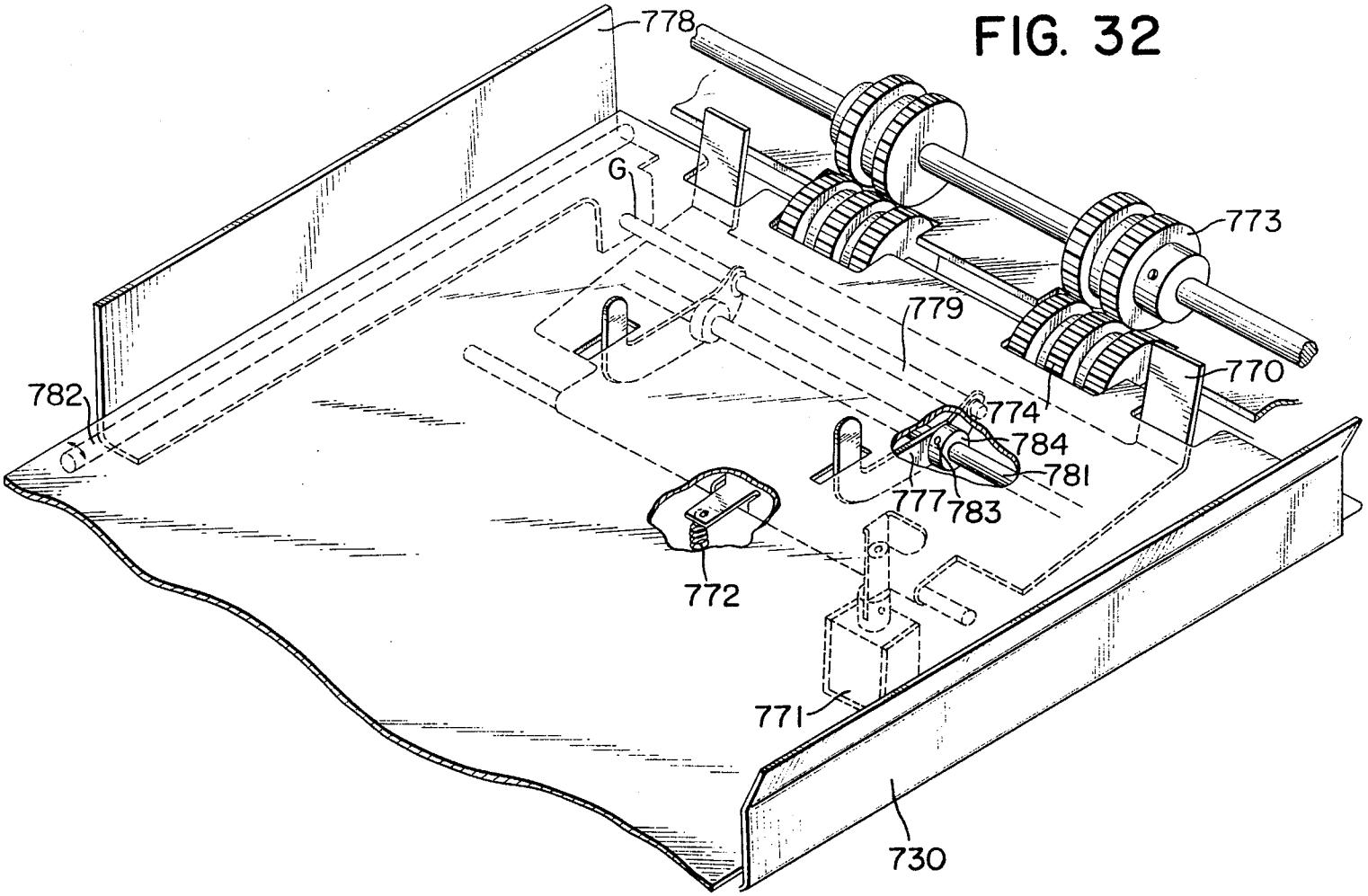
FIG. 32 is a perspective view showing the paper feed stock section in the third embodiment.
Figure 33:
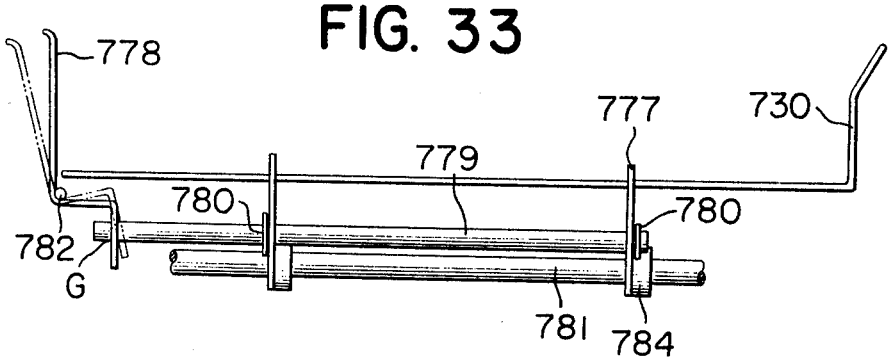
FIG. 33 is cross-sectional view of means for correcting the position of copy mediums for back-face copying.

Means for positively and effectively accomplishing the relocation of the paper is illustrated in FIGS. 31, 32 and 33.

A rocking arm 777, as indicated by phantom line, is normally retracted with respect to a paper feed plate 730 and thus makes no interference with copy paper as it is moved onto such feed plate. A correcting plate 778 (FIG. 33) is secured to a rockable shaft 782 as by welding to correct any lateral offset of the copy paper. A shaft 779 is loosely received in an opening G formed in a portion of the correcting plate 778, and the shaft 779 is rotatably mounted on the rocking arm 777 by means of anti-slip member 780. The rocking arm 777 is also secured to a shaft 781 by a screw 783 through a dowel 784, and rocking movement of the rocking arm 777 from the phantom-line position to the solid-line position in FIG. 31 may cause rocking movement of the correcting plate 778 from the phantom-line position to the solid-line position in FIG. 33.

As already described, when the copy paper is being discharged from the discharge rollers 22, the rocking arm is at its phantom-line position in FIG. 31 and accordingly, the correcting plate 778 is at its phantom-line position in FIG. 33. Thus, the copy paper comes to enter the paper feed plate 30 without encountering any interference. However, except when the copy paper is being discharged from the discharge rollers 22, the rocking arm 777 is rocked so that the correcting plate 778, the rocking arm 777 and the paper feed plate 30 become inclined, whereby the sheets of copy paper 17' on the paper feed plate are relocated in the longitudinal and transverse directions thereof so as to abut against the stop plate 770.

Figure 34:
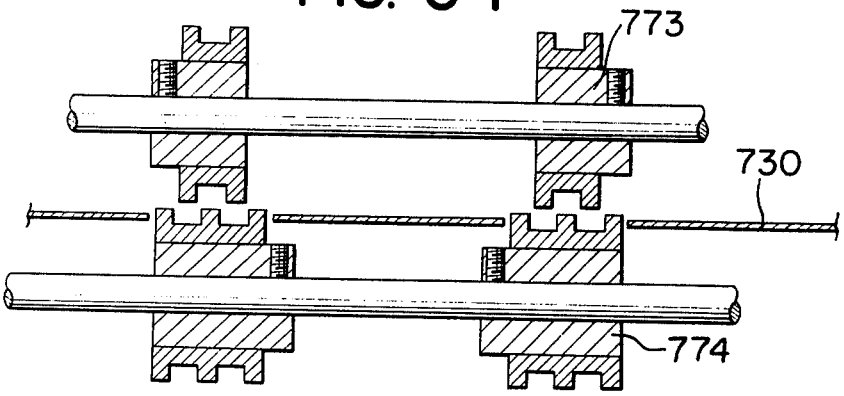
FIG. 34 is a cross-sectional view of the paper feed roller means.

Before the back-face copying course is entered, the stop plate 770 released from its position of FIG. 31 (in which the plate 770 is normally caused to act as a stop by the force of the spring 772) by the solenoid 771 and immuned from its duty as the stop, so that the copy paper 17' slides until the leading end A thereof reaches the paper feed rollers 773, 774. These feed rollers 773 and 774 are not in contact with each other and provide a slight clearance therebetween, as shown in FIG. 34. Therefore, when the copy paper have come to the feed roller means during the front-face copying course, the copy paper is again subjected a relocating action by the roller 774 being rotated in the direction of arrow as indicated in FIG. 31, in such a manner that the copy paper is about to be nipped between the rollers 773 and 774 but comes back to a position free from the action of the roller 774. Thus, the copy paper may become fully prepared for the back-face copying process before it enters such process.

The paper discharge tray 751 will now be described in particular. During the front-face copying course, as is shown in FIG. 31, the rocking member 752 forming a part of the paper discharge tray 751 and rockable about the rotary shaft of the discharge rollers 22 is raised to the phantom-line position by the action of a solenoid or the like (not showwn). Thus, sheets of copy paper passed through the fixing means 20 and discharged by the discharge rollers 22 are piled on the second paper feed means 750.

On the other hand, in the back-face copying course, the rocking member 752 restores its solid-line position so that sheets of copy paper 17' discharged from the discharge rollers 22 are piled on the paper discharge tray 751.

Figure 17:
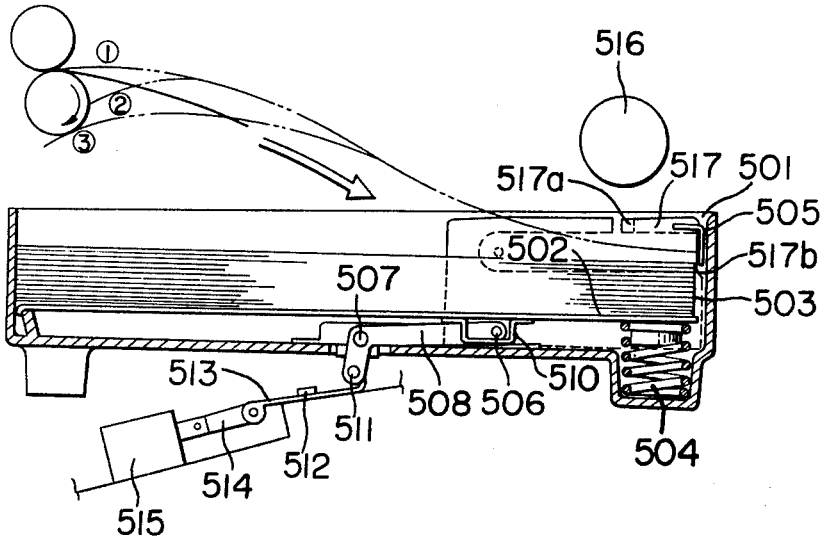
FIG. 17 is a cross-sectional view of the back-face copying paper feed section in the second embodiment.
Figure 18:
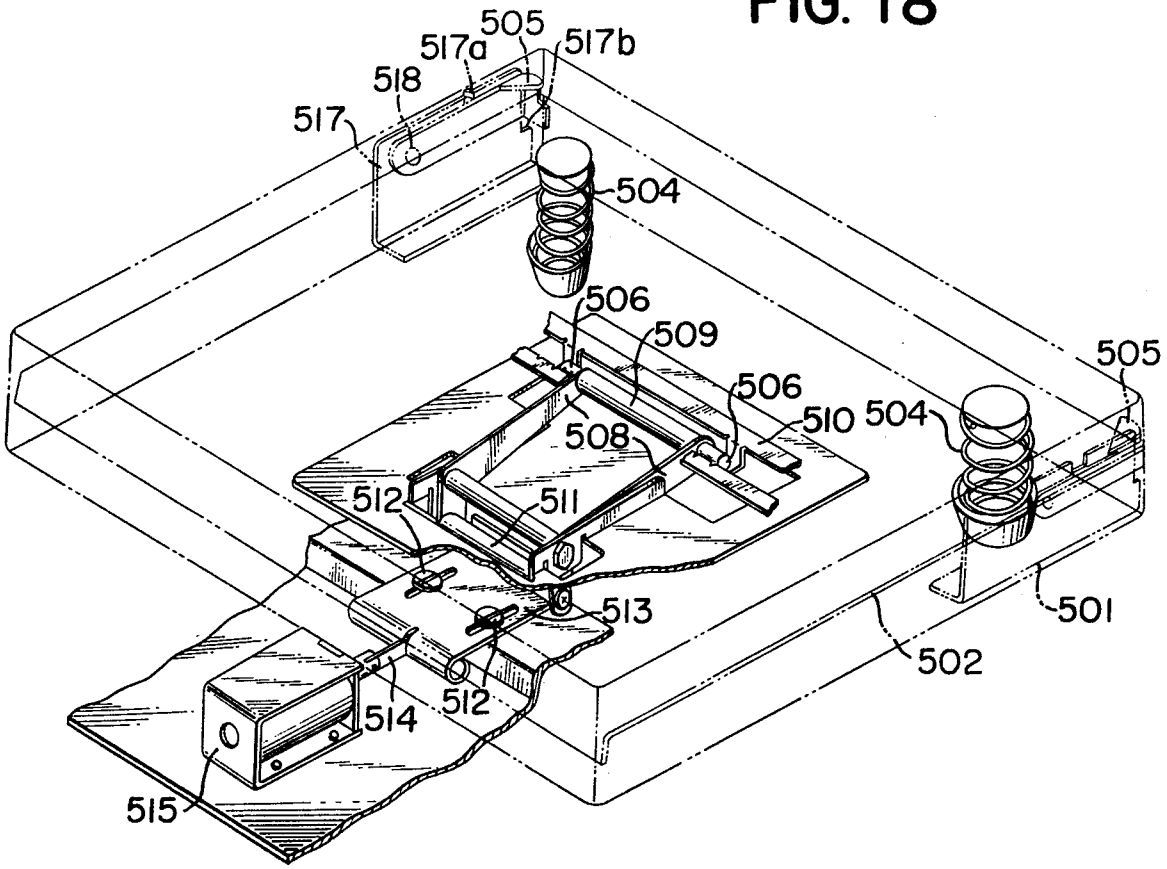
FIG. 18 is a perspective view corresponding to FIG. 17.

Next, a paper feed stock section 501 for the surface-B copying in FIG. 16 will be explained by reference to FIGS. 17 and 18. In the present embodiment, the paper feed stock section for the surface-B copying is a cassette removable from the machine body. Designated by 502 is an intermediate plate for supporting thereon sheets of copy paper 503. The intermediate plate 502 is normally biased upwardly by force springs 504, and rockable separator pawls 505 ride on top of the forward end of the copy paper stock. Each of the separator pawls is pivotally mounted on a shaft 518 secured to a pawl supporting plate 517, and portions 517*a* and 517*b* limit the range of pivotal movement of the separator pawl. Designated by 506 is a pin for lowering the intermediate plate 502, and it is secured to arms 508 with a stay 509 interposed therebetween, the arms 508 being pivotable about a shaft 507. A bracket 510 is secured to the intermediate plate 502 as by spot welding and holds the pin 506 therein. A rocking arm actuating shaft 511 is engageable with an arm 513 slidably mounted on the machine body by means of dowels 512, when the paper feed stock portion 501 for the surface-B copying is loaded on the machine body.

The other end of the arm 513 is rotatably connected to a connector piece 514, the other end of which is also rotatably connected to a solenoid 515, so that upon energization of the solenoid 515 the arm 513 pulls on the shaft 511 to move the rocking arms 508 to thereby lower the intermediate plate 502. The solenoid 515 is energized substantially simultaneously with the initiation of the surface-A copying to maintain the intermediate plate 502 away from the pawls, and continues to act from after the end of the surface-A copying course till before the start of the surface-B copying course. When the surface-B copying course is started, the solenoid 515 is deenergized to permit the intermediate plate 502 to be raised upwardly by the force spring 504, so that the pawls 505 strike against the forward top end of the copy paper stock, thus completing the preparation for the surface-B copying course. When the surface-B copying course is entered, a paper feed roller 516 is lowered to feed sheets of copy paper one by one from the paper feed stock section. On the other hand, the paper feed stock section 501 for the surface-B copying is readily removable from the machine body as already mentioned, and has an advantage that if the back-face copying should become unnecessary, the copy paper may be simply removed by withdrawing the cassette. As also described already, the paper feed stock section 501 is such that substantially simultaneously with the initiation of the surface-A copying, the solenoid 515 acts to lower the intermediate plate and in such condition, the leading end of the copy paper having completed the surface-A copying rushes in as shown by an arrow in FIG. 17, whereafter the leading end of the copy paper strikes against the pawls 505 while the trailing end of the copy paper is guided by rotation of the discharge rollers 22 in the manner as indicated by phantom lines 1, 2 and 3, whereby the copy paper is piled in the paper feed stock section with the leading end thereof restricted by the pawls so as to be conveniently set in preparation for the subsequent surface-B copying.

Figure 19:
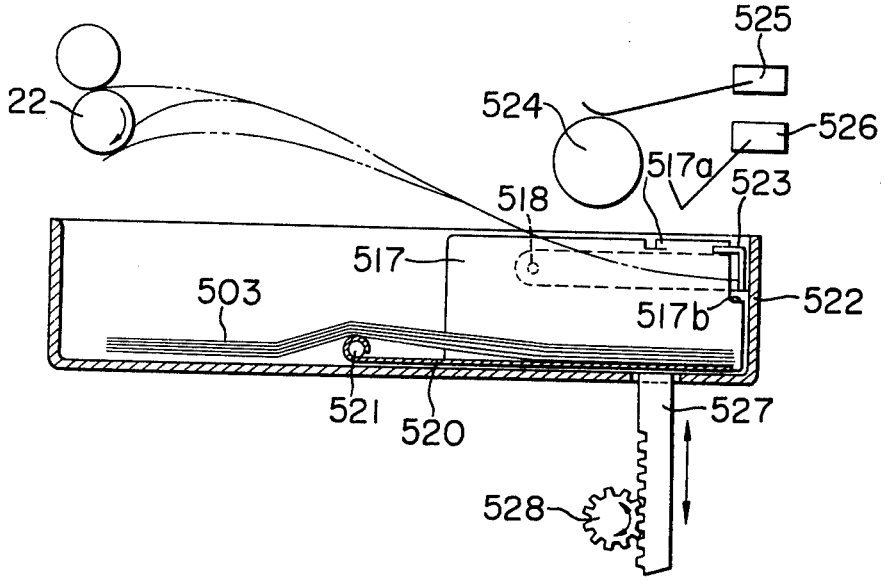
FIGS. 19, 20 and 21 are cross-sectional views showing an embodiment of the paper feed stock means.
Figure 20:
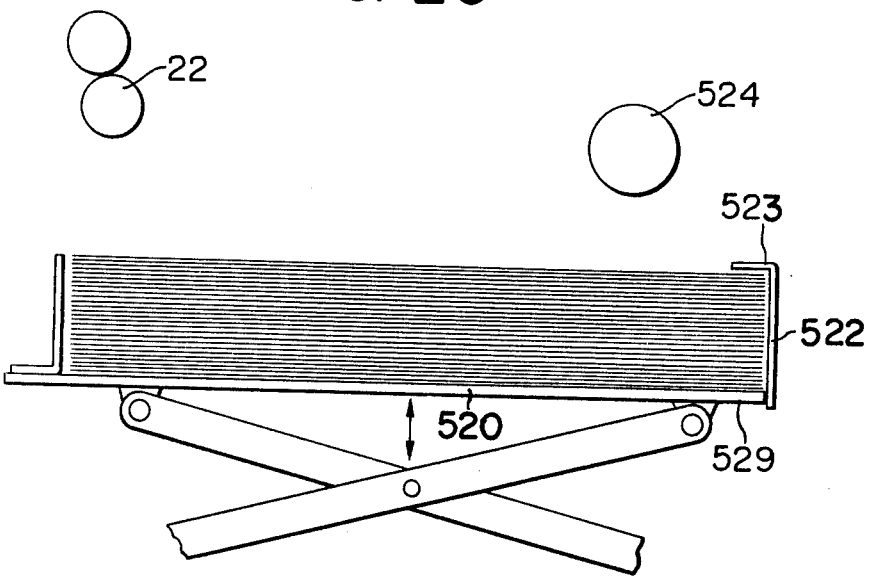
Figure 21:
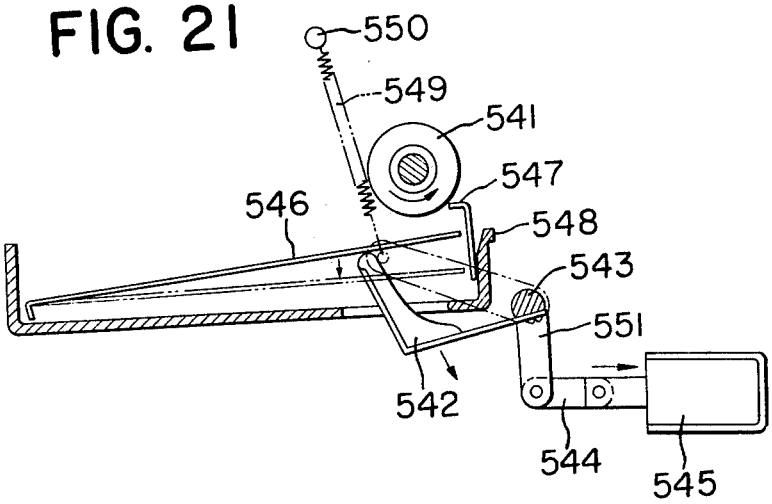

Although the force spring 504 is employed to support the vertically movable intermediate plate 502, this is not the only possible means for vertically moving the intermediate plate in preparation for the subsequent paper feed step but use may be made of such means as shown in FIGS. 19, 20 and 21. Referring to FIG. 19, there are seen sheets of copy paper 503, an intermediate plate 520 for supporting the copy paper having a pivot shaft 521, a housing 522 for containing therein the stock of copy paper, pawl means 523 pivotally mounted on a shaft 518 secured to a pawl supporting plate 517 having portions 517*a* and 517*b* for restricting the range of pivotal movement of the pawl means, a paper feed roller 524, microswitches 525 and 526 having an actuator, a rack 527 for vertically moving the intermediate plate 520, and a gear 528 for vertically moving the rack 527. During the surface-A copying course, the rack 227 is in its lowered position as shown and the intermediate plate is also in its lowered position due to gravity.

In such position, the sheets of copy paper are piled on the intermediate plate 520 and when the preparation for the surface-B copying course is completed, the rack 527 is moved upwardly by the drive of the gear 528 to cause the pawl means 523 to strike against the forward top end of the copy paper stock and, when the pawl means further comes to ride on the forward top end of the copy paper stock, the top surface of the copy paper stock strikes against the paper feed roller 524. The paper feed roller 524 has some vertical play so as to engage the copy paper stock uniformly throughout the width thereof. When the top surface of the copy paper stock is forced further upwardly by the rack 527, the paper feed roller portion actuates the microswitch 525 to rotate the paper feed roller, thus initiating the paper feed step. At the next moment, the rack 527 is lowered.

The microswitch 526 serves to detect the presence of copy paper and may produce a zero signal if no copy paper is present in the course of upward movement of the intermediate plate.

Instead of the above-described paper feed stock means and paper feed means, use may be made of means in the form of a copy paper accommodation housing 529 as shown in FIG. 20 wherein a housing 522 and an intermediate plate 520 are vertically movable together. In such case, the pawl means 523 may be secured to the copy paper accommodation housing in the manner as shown in FIG. 20.

Alternatively, the means for vertically moving the intermediate plate in preparation for the subsequent paper feed step may employ such a method as shown in FIG. 21.

Referring to FIG. 21, an intermediate plate 546 is vertically movably disposed within a cassette 548 having an opening formed in the bottom wall thereof through which a pressure imparting member 542 extends. The pressure imparting member is secured to a shaft 543 to which is also secured a two-arm member 551, to one end of which is connected a spring 549 having the other end secured to a spring hooking pin 550, so that the pressure imparting member is caused by the spring 549 to normally force up the intermediate plate 546. Connected to the other end of the two-arm member through a connector member 544 is a solenoid 545 and operation of this solenoid 545 (direction of arrow) causes the pressure imparting member to be lowered in the direction of arrow, which in turn causes lowering of the intermediate plate 546 to its position indicated by phantom line.

Now, where such a paper feed stock section for surface-B copying is provided, the solenoid 545 is operated during the surface-A copying course so that the intermediate plate 546 is brought away from the pawls 547 to permit the surface-A copying course to be completed, and such condition is continued until before the surface-B copying course is started.

As soon as the surface-B copying course is started, the solenoid 545 is deenergized so that the intermediate plate 546 is forced upwardly by the pressure imparting member 542 to cause the pawls 547 to strike against the forward top end of the copy paper stock. This completes the preparation for the surface-B copying course and when the surface-B copying course is entered, the paper feed roller 541 is intermittently rotated in the direction of the arrow to thereby feed sheets of copy paper one by one from the paper feed stock section.

Figure 22:
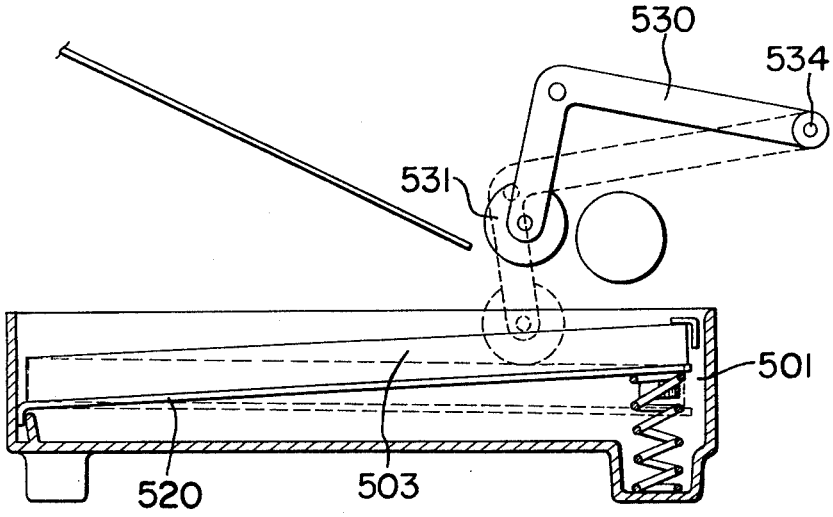
FIG. 22 is a cross-section of an embodiment of the means for relocating the copy medium for back-face copying in the paper feed stock section.
Figure 23:
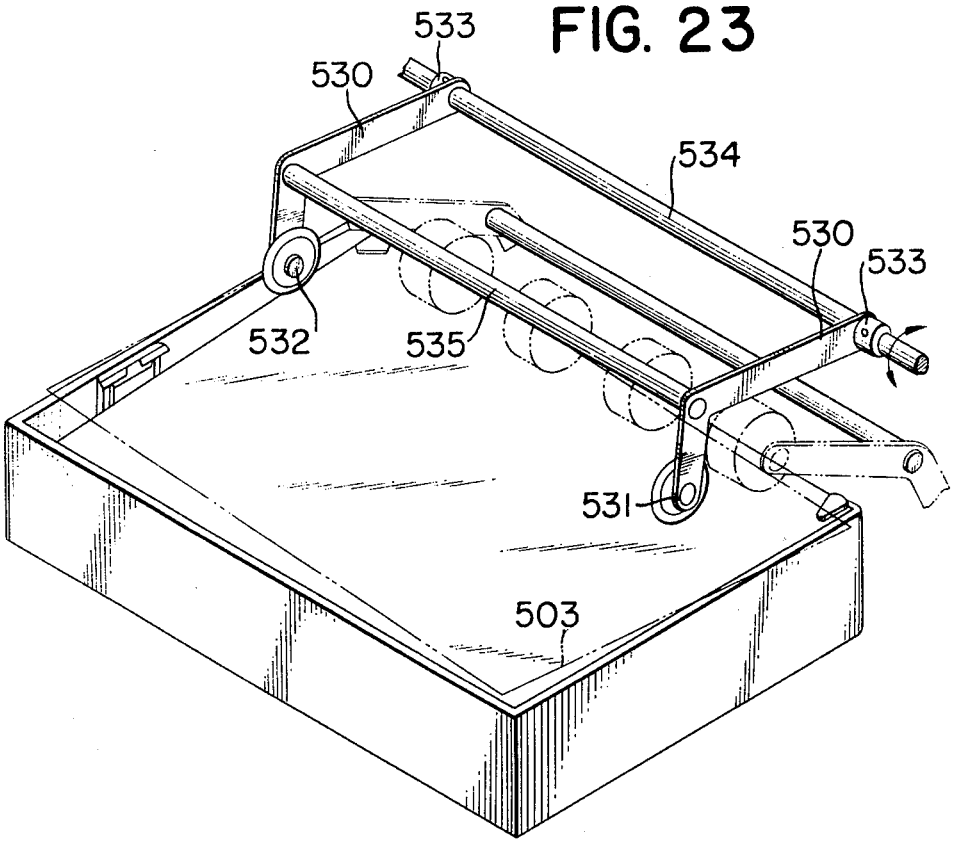

FIGS. 22 and 23 show a relocating mechanism in the paper feed stock section of the type using the pivotable intermediate plate 520 as shown in the present embodiment, which mechanism can relocate sheets of copy paper to the paper feed stock section 501 for surface-B copying when such sheets of copy paper have been introduced into the stock section but irregularly positioned with respect thereto, for example, when a sheet of copy paper 503 to be subjected to the back-face copying course has entered somewhat obliquely with respect to the paper feed stock section, in the manner as shown in FIG. 23. In this FIG., a pair of levers 530 each have a shaft 532 secured thereto. A roller 531 is rotatably mounted on each shaft 532. A boss 533 is secured to each lever 530 and also secured to a rotatably shaft 534 as by screws. A stay 535 is provided to fix the opposite levers 530. Rotation of the shaft 534 in the direction as indicated by the arrows in FIG. 23 causes reciprocal movement of the rollers 531 between the solid-line and the dotted-line position in FIG. 22. Thus, even if the copy paper 503 has entered somewhat obliquely with respect to the stock section as shown in FIG. 23, the up and down movement of the rollers 531 in the present mechanism as shown in FIG. 22 imparts to the copy paper 503 an action of forcing the copy paper into the stock section 501. Such up and down movement is repeated several times, whereby the copy paper 503 is relocated to the stock section. In this manner, the operation of the relocating mechanism taking place prior to the shift into the back-face copying course enables the copy paper to be conveniently prepared for the ensuing back-face copying course. The rollers 531 should desirably be disposed near the pawled portion of the back-face copying paper feed stock section and near the opposite side edges of the copy paper as viewed in its direction of movement. Such rollers are not restrictive but use may be made of any means which will intermittently be forced with respect to the surface of the copy paper.

Figure 26:
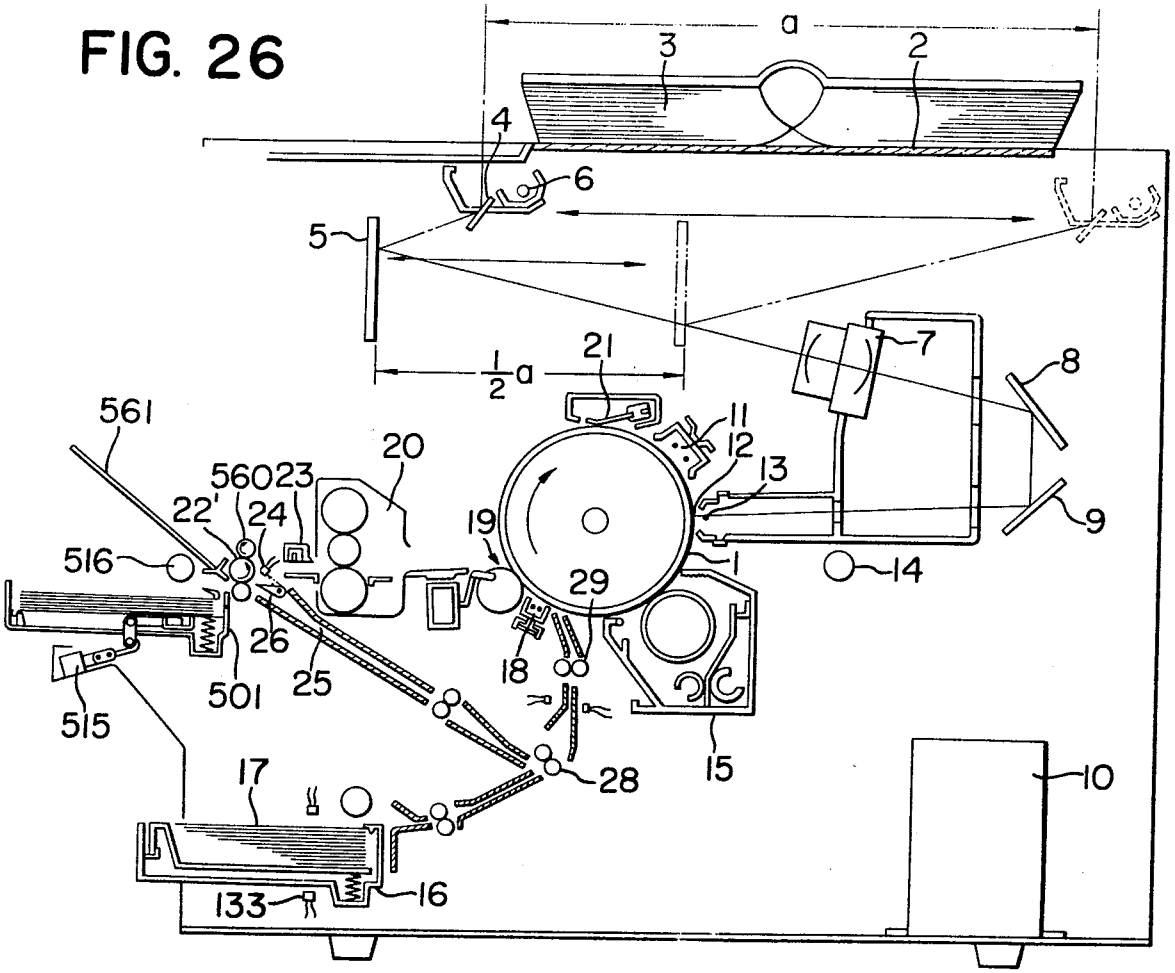
FIG. 26 is a cross-sectional view showing another form of the second embodiment.
Figure 27:
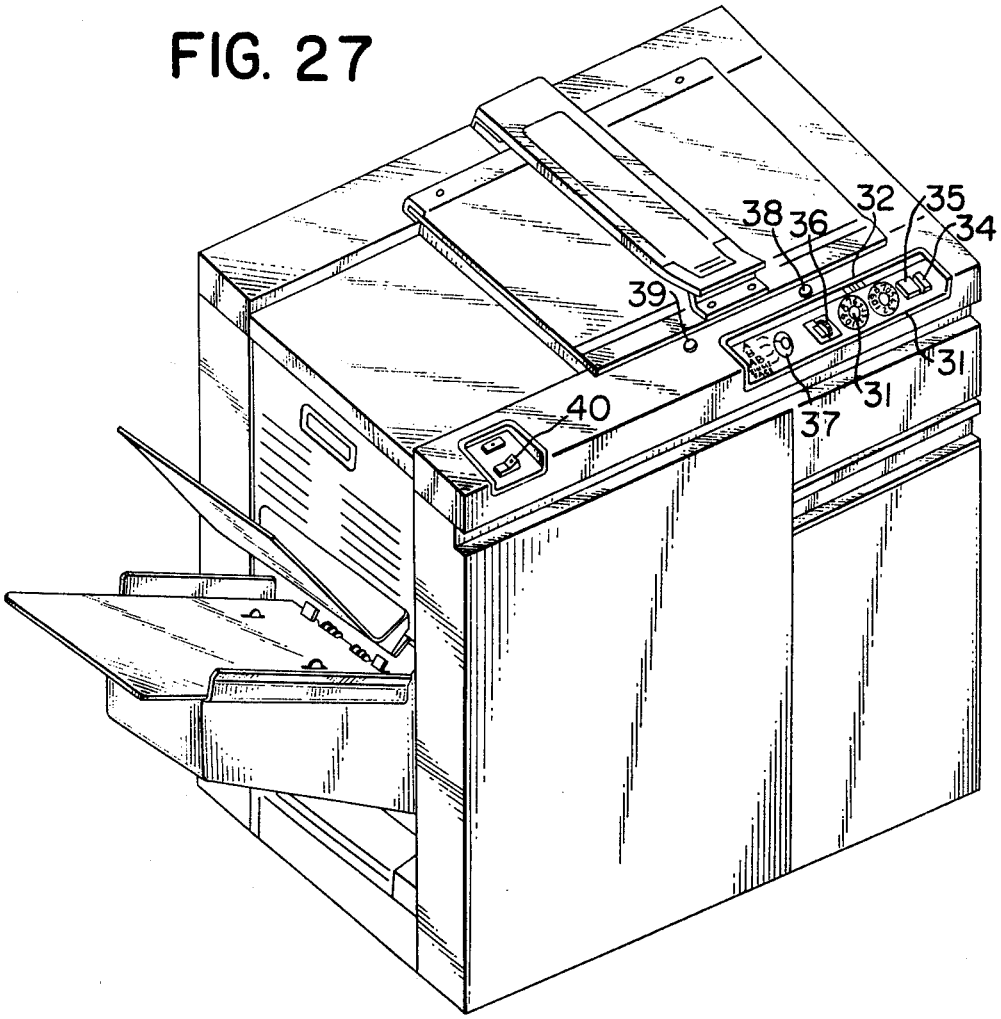
FIG. 27 is a pictorial, perspective view of a third embodiment of the copying machine according to the present invention.

Alternatively, the surface-B copying paper feed stock section 501 described above may be installed at the position of the tray 30 shown in FIG. 16, as will be seen in FIG. 26. In such case, the intermediate plate is brought away from the pawls during the surface-A copying course and the surface-B copying paper feed stock section 501 receives sheets of copy paper discharged by the discharge rollers 221, whereafter the intermediate plate is forced upwardly during the surface-B copying course so that the forward top end of the copy paper stock strikes against the pawls, thus completing the preparation for the surface-B copying course. Subsequently, the surface-B copying course is entered and sheets of copy paper are fed one by one by the paper feed roller 516 and guided to the back-face copying passageway 25 by the discharge rollers 221 which are now rotated in the opposite direction from that during the surface-A copying. By this time, the guide plate 26 has been displaced to its position as indicated by dotted line.

The copy paper having completed the back-face copying is guided by the guide plate 26 (dotted line) and discharged onto the discharge tray 561 by the discharge rollers 22' and follower rollers 560 (during the surface-B copying course, rotation of the discharge rollers 22' is always in the direction of arrow as shown in FIG. 26).

Copying Operation

Figure 2:
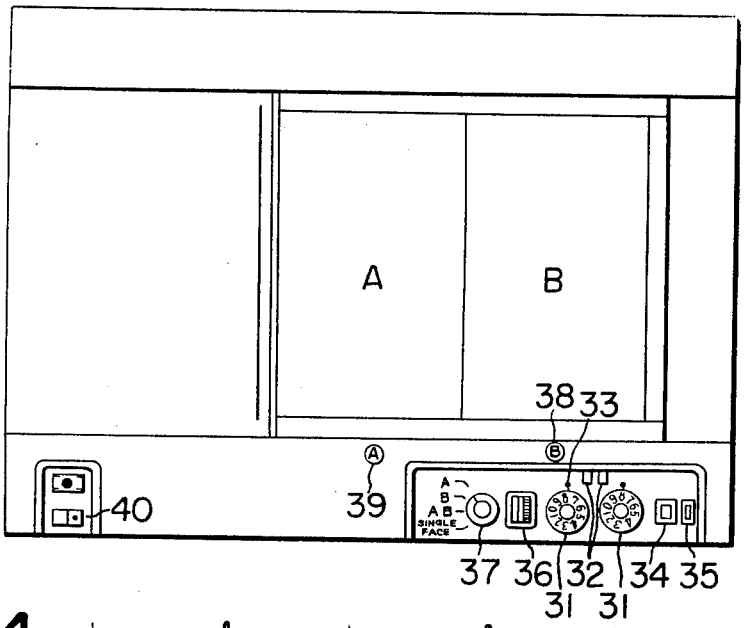
FIG. 2 is a plan view of the operating panel of the machine.

Reference will now be had to FIGS. 1 and 2 to describe in detail the copying operation of the copying machine shown in FIGS. 3 and 16. Designated by 40 is a main switch for rendering the copying machine operative.

A copy number set dial 31 can set the number of copies up to any number from 1 to 99 by registering any desired digit on the dial to the index mark. Designated by 32 is a copy number indicating tube for indicating the number of copies from time to time. A copy start button 34 is provided which is used when a plurality of copies are to be produced. When a single copy is desired, another copy start button 35 may be depressed to ensure only one copy to be produced independently of the number indicated by the copy number set dial 31. Designated by 36 is a gradation selecting dial for determining the gradation of the resultant image, and 37 a copy mode selecting dial for selecting one of various copy modes, i.e. surface-A copy, surface-B copying, single-face copying and both-face copying (AB).

For the surface-A copying, the dial 37 is set to A, whereby the indicator lamp A is turned on to permit the copying to take place only for the surface A of the original carriage and the copy paper is not discharged onto the tray but, after the trailing end of the copy paper is detected by the light-sensing element 24 as shown in FIGS. 3 and 16, the copy paper is guided to the back-face copying passageway by the actions of the solenoid 58 and electromagnetic clutches 53, 54 and comes to a halt in the surface-B copying paper feed means. Where multiple copies are to be obtained, sheets of copy paper are one by one guided to the back-face copying passageway so that a predetermined number of copy sheets are piled in the surface-B copying paper feed means.

For the surface-B copying, the dial 37 is set to B, whereby the indicator lamp B is turned on to permit copying to take place only for the surface B of the original carriage and, irrespective of the number of copies to be produced, copy paper is supplied from the surface-B copying paper feed means as long as copy paper having completed the surface-A copying is present therewithin, but copy paper is supplied from the cassette when no copy paper is present within the surface-B copying paper feed means. In either case, copy paper is discharged onto the paper discharge tray 30 after completion of the copying. If the dial 37 is set to the single-face copying, neither of the indicator lamps A and B will be turned on. The single-face copying can be effected up to the format A3 size as in the conventional copying machines and each copy sheet having completed the single-face copying is directly discharged onto the paper discharge tray 30.

Next, when the dial 37 is set to AB and the copy number set dial is set to a predetermined number, the surface-A copying course is repeated for the predetermined number of copies and the copy sheets having completed the surface-A copying are guided to the back-face copying passageway so that the predetermined number of copy sheets are piled in the surface-B copying paper feed means, and upon completion of the predetermined number of copies for the surface-A, the copy sheets now automatically enter the surface-B copying course wherein the surface-B copying is repeated for a predetermined number of copy sheets until the surface-B copying course is completed, whereafter each copy sheet is discharged onto the paper discharge tray.

In the copying machine of FIG. 31, the predetermined number of copy sheets having completed the copying and piled on the paper feed plate 730 are relocated by the rocking arm 777 and correcting plate 778 and thus prepared for the surface-B copying.

Next, for the surface-B copying, the dial 37 is set to B, whereby the indicator lamp B is turned on to permit copying to take place only for the surface-B of the original carriage, and irrespective of the number of copies desired, copy paper is supplied from the paper feed plate 730 as long as copy paper having completed the surface-A copying is present on that plate, but supply of copy paper is done from the casette 16 when there is no copy paper on the paper feed plate 730, and after completion of the copying, the copy paper is discharged onto the paper discharge tray 751. When the copy dial 37 is set to the single-face copying, neither of the indicator lamps A and B is turned on. Thus, single-face copying can be effected up to the format A3 size as in the conventional copying machines and the copy paper having completed the single-face copying is directly discharged onto the discharge tray 751.

When the dial 37 is set to AB and the copy number set dial is set to a predetermined number, the surface-A copying is repeated for the predetermined number of copy sheets. When the surface-A copying is completed for the predetermined number of copy sheets, the surface-B copying course is now automatically entered so that the surface-B copying is repeated for the predetermined number of copy sheets, and the copy sheets having completed the surface-B copying are discharged onto the paper discharge tray.

Each embodiment operates in the above-described manner and can therefore provide various conveniences to the both-face copying. For example, where the front and back surfaces of an original such as a leaf of an ordinary book are to be copied, the front and back surfaces cannot be placed on the original supporting surface at a time. Even in such case, if a plurality of consecutive pages of the book are to be copied, the book is opened and placed on the original carriage with the spread-over pages resting on the respective original supporting surfaces. The selector dial 37 is set to B, whereby the back-face of a first copy sheet copies the original resting on the surface-B and is then discharged, whereafter the front-face of a second copy sheet copies the original resting on the surface-A.

A leaf of the book is turned over.

The dial 37 is then set to B, whereby the back-face of the second copy sheet copies the original resting on the surface-B.

Subsequently, the dial 37 is changed over to A, whereby the front-face of a third copy sheet copies the original resting on the surface-A.

Another leaf of the book is turned over.

The dial 37 is set to B, whereby the back-face of the third copy copies the original resting on the surface-B.

Next, the dial 37 is changed over to A, whereby the front face of a fourth copy sheet copies the original resting on the surface-A.

By effecting the copying in the manner as described just above, the two originals spread over on the original supporting surface are copied not on both faces of the same copy sheet but on one face of a first copy sheet and on the other face of a second copy sheet, respectively. In this case again, the two surfaces to be copied are placed on the original carriage at a time. As a matter of course, when a plurality of copies are desired, the copy number set dial may be set to the desired number and the surfaces A and B may likewise be copied alternately.

In such as case, it is necessary, as already described, in order to simplify the operating procedures that the book be set on the original carriage with an odd-numbered page resting on the surface-A and an even-number page on the surface-B.

Which page of the book on the original carriage is being copied may be simply known because the indicator lamps 39 and 38 for surfaces A and B provided adjacent to these surfaces are selectively turned on.

Next, where two separable surfaces to be copied are separately placed on the surfaces A and B of the original carriage and are to be copied on both faces of a single copy sheet, the both-face copying may be done in the manner described below.

First, the copy number set dial 31 is set to a desired number of copies, and then the selector dial 37 is set to AB, whereafter the copy start button 34 is depressed, whereby the desired number of copies may be provided automatically. In this case, both of the indicator lamps 39 and 38 for A and B are turned on to tell that the both-face copying is taking place automatically. Thus, it is a feature of the present copying machine that whenever case of both-face copying may take place, the both-face copying may be accomplished without accompanying any complication in operation.

The foregoing description has been made with respect to the case where the original carriage is sized enough to cover the format A3 size and a format A4 book or the like is copied on copy paper of A4 size by the surface-A and the surface-B copying. The present invention also provides a copying machine which is further improved in the above-described function so as to be simply operable to accomplish the surface-A and the surface-B copying for the other sizes than format A4 (for example, copying of a format B5 book on copy paper of B5 size by the surface-A and the surface-B copying).

Therefore, the copying machine of the present embodiment has an original carriage sized enough to cover the format A3 size and can copy a format A4 book on copy paper of A4 size by the surface-A and the surface-B copying, as well as a format B5 book on copy paper of B5 size by the surface-A and the surface-B copying. This will hereinafter be described by reference to FIGS. 28 to 30.

Figure 28:
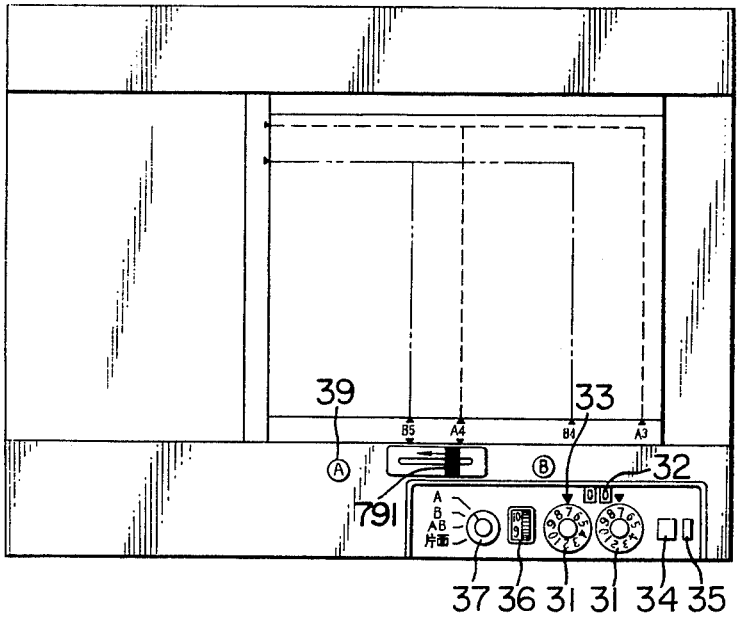
FIG. 28 is a plan view of the operating panel in the third embodiment.

Referring to FIG. 28, there is added a setting member 791 to the operating panel portion of the copying machine of the present invention, which setting member is movable in the direction of arrow in accordance with the size of an original to be subjected to the surface-A or the surface-B copying course so as to clearly indicate the divider line dividing the original supporting surface into the surfaces A and B. For example, when the surface-A and the surface-B copying are to be effected with a format A4 book as the original, the book is opened and placed on that portion of the original carriage encircled by the dotted line in FIG. 28 so that the binding line of the book is just aligned with the dotted line of the index mark designated as A4. If the surface-a and the surface-B copying are to be effected with a format B5 book as the original, the book is opened and placed on that portion of the original carriage encircled by the dots-and-dash line so that the binding line of the book is just aligned with the dots-and-dash line of the index mark designated as B5. Thus, for example, when a format B5 book is to be subjected to the surface-A and the surface-B copying, the format B5 book may be opened and placed on the carriage in the described manner and the setting member 791 may be moved to the index mark of B5 size, whereby the surface-A and the surface-B copying for B5 size may be accomplished in a manner similar to that described with respect to the surface-A and the surface-B copying for A4 size.

An internal mechanism operatively associated with the setting member 791 and the reason therefor will now be described by reference to FIGS. 29 and 30.

Describing first the mechanism associated with the setting member 791, this setting member 791 is secured to a setting member mounting plate 793 to which are also secured microswitches 136, 137 and 138. The setting member mounting plate 793 is slidable and may be guided by the cooperation of the slots therein with slide guide pins 794 secured to a plate 790 fixed to the machine body. The plate 790 is formed with teeth meshing with a gear 797 rotatably mounted on a pin 796 secured to the setting member mounting plate 793.

On the other hand, a microswitch 139 is secured to a mounting plate 799, which is slidable by cooperation of the slots therein with pins 798 secured to a plate 795 fixed to the machine body. The mounting plate 799 is also formed with teeth meshing with the gear 797.

Figure 30:
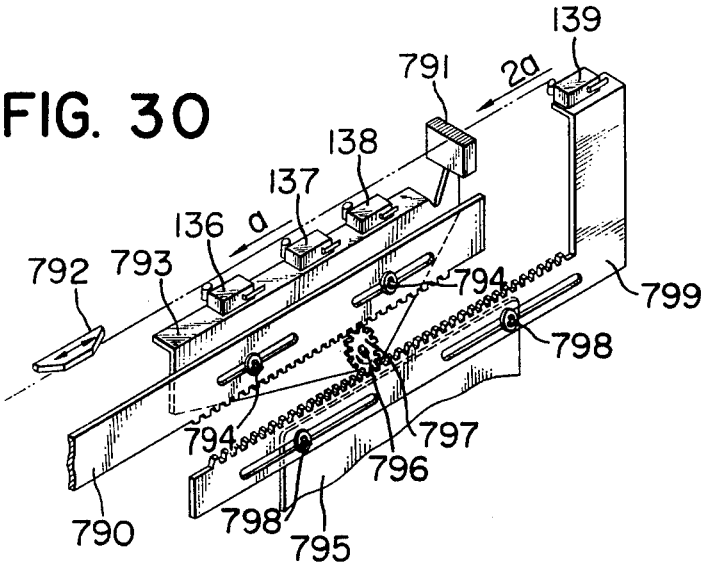
FIG. 30 is a perspective view of an original size change-over lever.

Thus, in FIG. 30, if the setting member 791 is moved over a distance *a*, the mounting plate 799 and accordingly the microswitch 139 will slide over a distance 2*a* in the same direction as the setting member.

Figure 29:
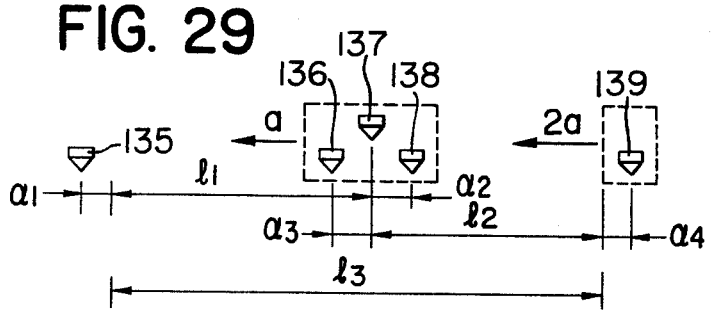
FIG. 29 illustrates the positions of microswitches for the optical system.

Thus, if in FIG. 29, $l_1 = l_2$ = transverse width of the format A4 size is for example, $l_1 - a = l_1'$ ($l_1'$ = transverse width of the format B5 size) and $l_2' = l_2 - a$, then $l_1 = l_2'$ = transverse width of the format B5 size, and this can be realized by the use of the mechanism shown in FIG. 30. According to this mechanism, the surface-A and the surface-B copying for any desired size (A4 or smaller size in the shown embodiment) may become possible and in addition, the distance of movement of the optical system may become shorter for the smaller sizes (the period of the copying cycle may become shorter), so that the number of copies produced per unit time can be increased.

Operation of the mechanism will further be described. The setting member 791 may be moved, for example, from the index mark A4 to the index mark B5 as shown in FIG. 28, whereafter a format B5 book may be opened and placed on the original carriage with the binding line of the book aligned with the index mark B5.

Thus, the present invention enables the surface-A and the surface-B copying for various sizes to be accomplished through a simple operation.

In the present embodiment, if the setting member mounting plate 793 having the microswitches 136–138 secured thereto is moved over the distance *a*, the mounting plate 799 having the microswitch 139 secured thereto may automatically move over the distance 2*a* in the same direction, but as an alternative, the setting member mounting plate 793 alone is movable while the microswitch 139 may be stationary. In the latter case, the exposure stroke during the surface-B copying will be somewhat longer but such alternative design will still be convenient to produce copies of various sizes.

It will thus be seen that a feature of the present copying machine is that whatever case of both-face copying may take place, the both-face copying can be accomplished without accompanying any complication in operation.

Although the invention has been described with the first and the second paper feed means and the surface-A and the surface-B copying related together, it is also possible with a copying machine having no both-face copying function that the original supporting surface is divided into surfaces A and B to thereby permit two pages of the original to be placed thereon at the same time.

In such a case, the two spread-over pages of the opened book will automatically and continuously be copied on one side of two sheets of copy paper. The copy paper used may include sheet-like members such as transparent paper and offset master paper.

Detailed description will now be made of the back-face copying paper feed means and means for separating sheets of copy paper piled in said feed means to feed them one by one to the back-face copying course.

In FIGS. 3, 10, 11 and 12, reference numeral 470 designates an upper guide plate for guiding sheets of copy paper 481 as they enter the back-face copying course, and 471 a paper feed plate capable of supporting thereon these sheets of copy paper which have been brought thereto.

Designated by 471 and 473 are separator-feeder rollers rotated in the opposite direction (as indicated in FIG. 3) to feed an uppermost one of the copy sheets for the back-face copying toward the conveyor rollers 28 and the register rollers 29.

Figure 12:
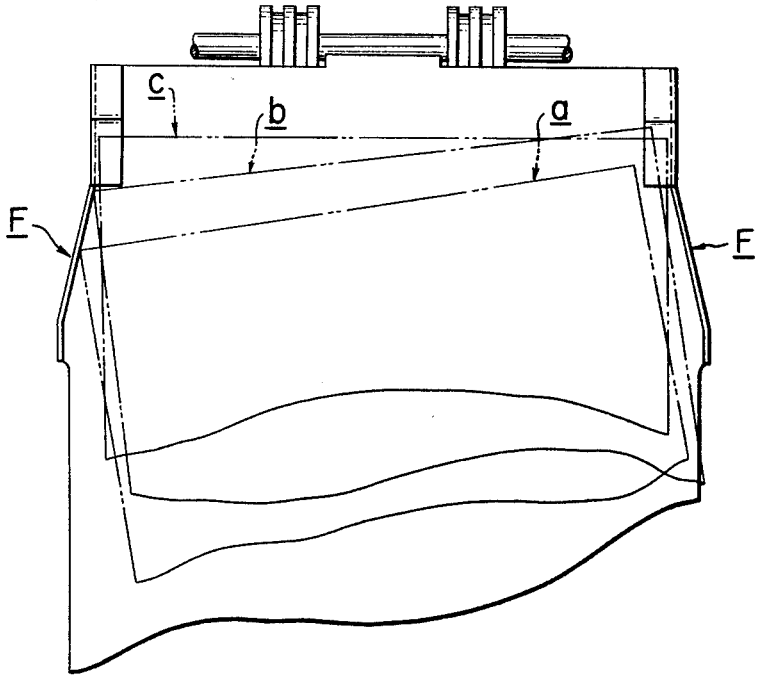
FIG. 12 illustrates the correction of oblique entry of copy medium.

As will be seen in the embodiment of FIG. 3, the paper feed plate 471 may preferably be inclined forwardly downwardly with respect to the direction of movement of copy paper so that the leading end of copy paper may more readily be relocated by the separator-feeder rollers 472, 473. Also, as the means for positively effecting the relocation, use may effectively be made of such rocking arms as shown in FIGS. 3, 10 and 12. In FIGS. 3 and 10, the rocking arms are designated by 475 and normally retracted with respect to the paper feed plate 471, as indicated by phantom line, so that they do not interfere with the copy paper coming onto the paper feed plate 471.

When the back-face copying course is entered, the rocking arms are rocked about a shaft 476, whereby the copy paper on the paper feed plate 471 is squeezed so as to be more readily relocated relative to the separator-feeder roller, thus assisting in smooth paper feed. (Each rocking arm 475 has secured thereto a boss 477 which is in turn secured to the shaft 476 as by screws, and the shaft 476 is rotatably).

Figure 13:
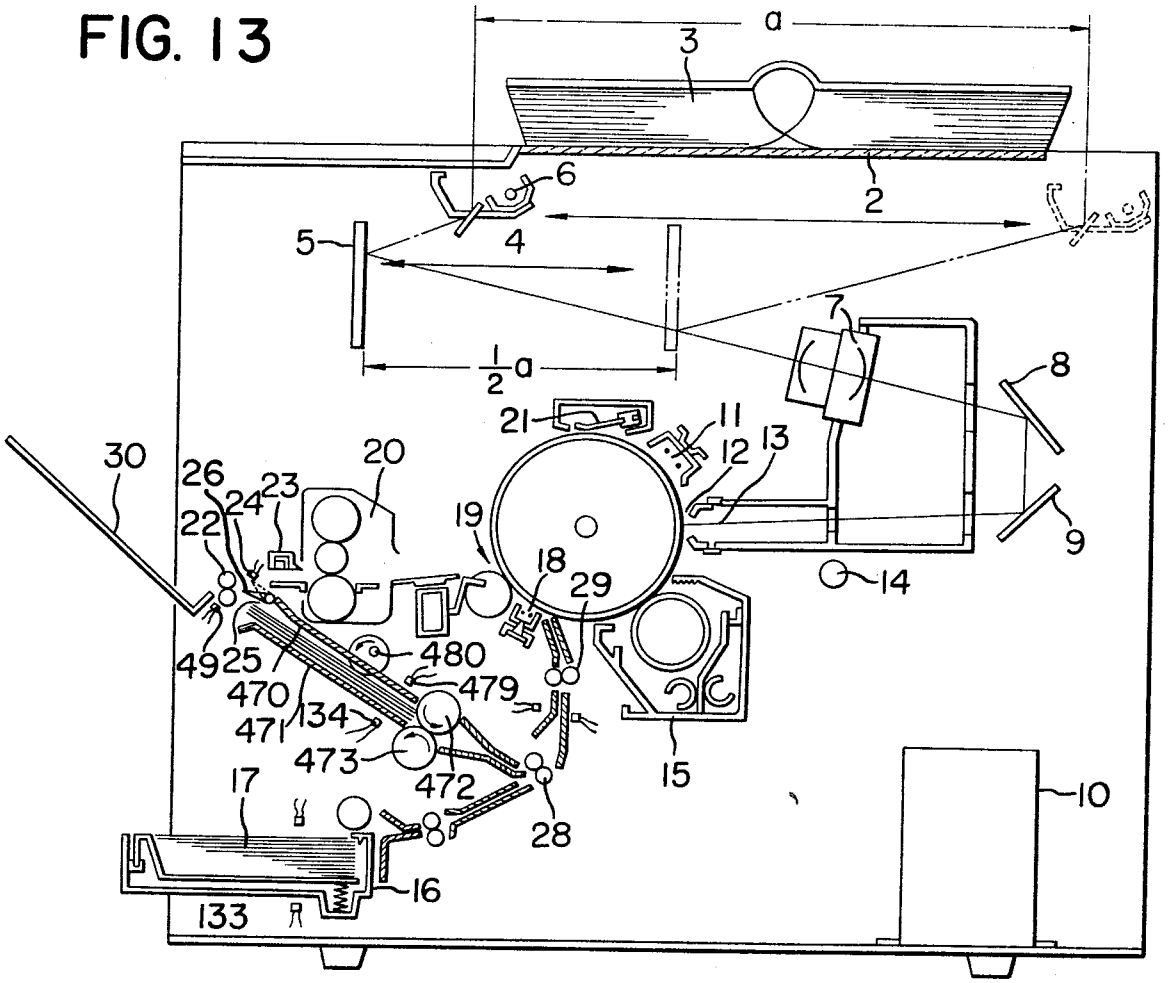
FIGS. 13 and 14 are cross-sectional views showing other forms of the first embodiment.
Figure 14:
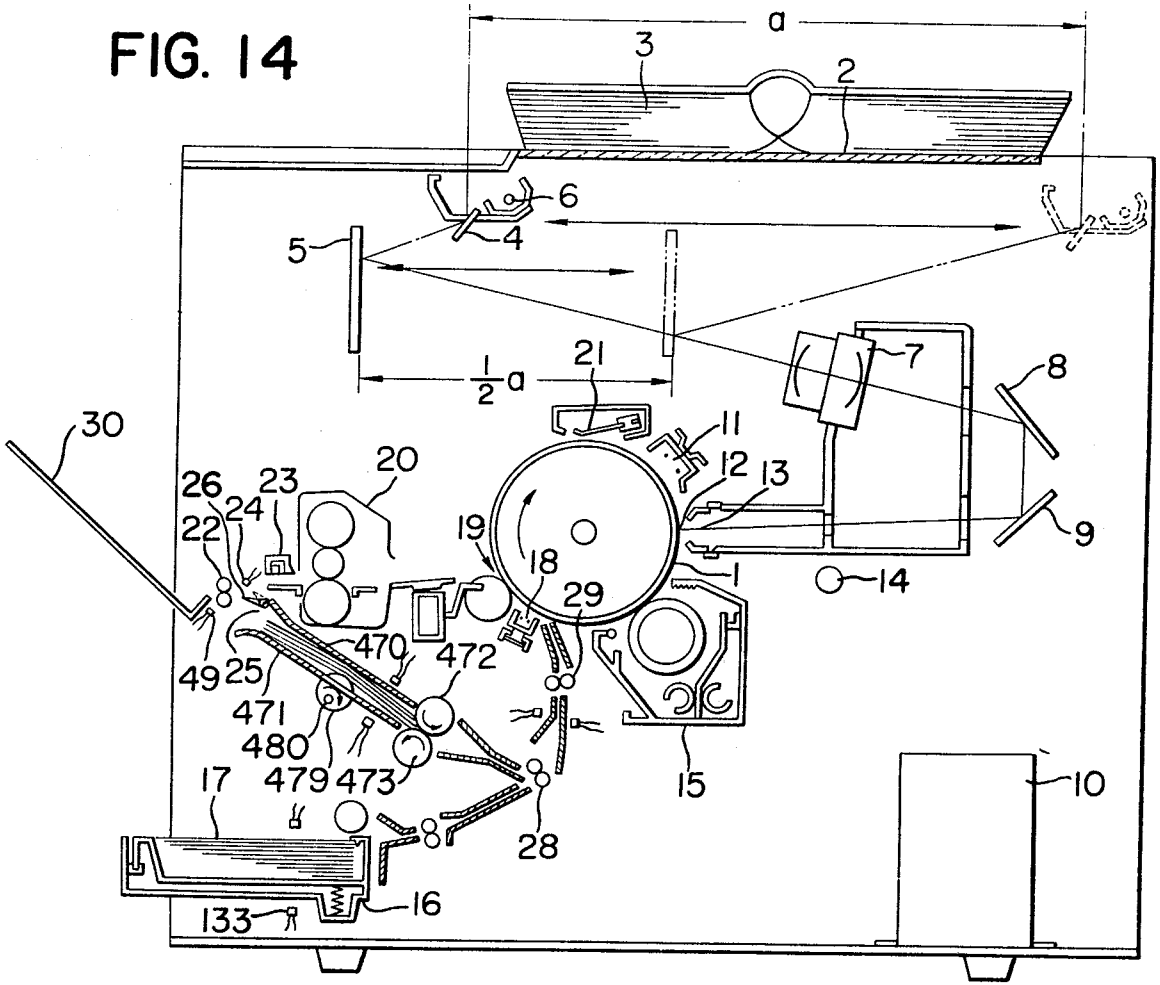

The relocating means for copy paper may also be designed as shown in FIGS. 13 and 14, wherein a roller (or cam-like member) is eccentrically mounted with respect to a shaft 480 and rotatable to intermittently squeeze the copy paper.

As regards the relocation of the paper, the paper feed plate 471 has the opposite, sector-shaped, side walls serving as paper guides, as indicated at F in FIGS. 10 and 12, so that even if the copy paper comes in obliquely as indicated by *a* in FIG. 12, it may be guided with one of the forward corners thereof striking against one of the side walls of the plate 471, whereby the copy paper may be relocated in the manner as indicated by *b* and *c*, thus being conveniently prepared to be fed for the back-face copying.

Figure 11:
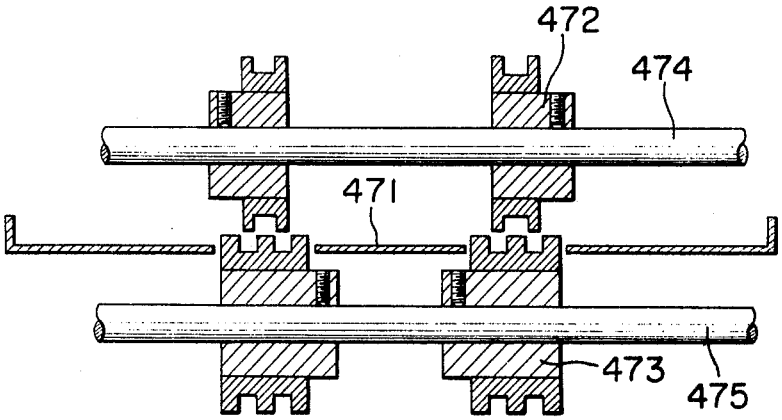
FIG. 11 is a cross-sectional view corresponding to FIG. 10.

The separator-feeder rollers 472 and 473 are not in contact with each other but provide a slight clearance therebetween, as shown in FIG. 11. Therefore, when the copy paper for back-face copying has come to the separator-feeder rollers during the front-face copying course, the copy paper is again subjected to a relocating action by the roller 473 rotating in the direction of arrow as indicated in FIG. 14, in such a manner that the copy paper is about to be nipped between the rollers 472 and 473 but comes back to a position free from the action of the roller 473. Thus, the copy paper may become fully prepared for the back-face copying course before it enters such course.

Figure 15:
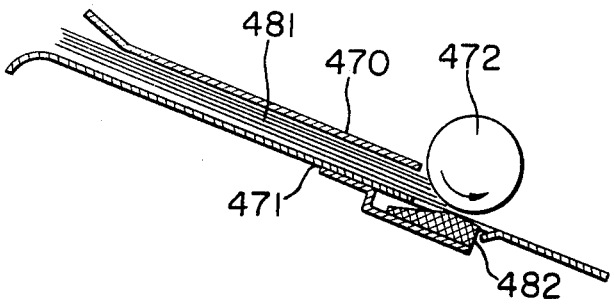
FIG. 15 illustrates another example of the paper feed in the paper feed stock section.

The example shown in FIG. 15 employs, instead of the separator-feeder roller 473 as shown in FIGS. 3, 13, and 14, a stationary member 482 installed so as to provide a moderate clearance with respect to the separator-feeder roller 472. The stationary member has a moderate friction coefficient and a plurality of such members may be provided. Again by the use of such stationary member of members, sheets of copy paper for back-face copying may be piled on the paper feed plate 471 during the front-face copying course, and may be separated one by one during the ensuing back-face copying and transported to the conveyor rollers 28 and register rollers 29.

The invention has hitherto been described with the first and the second paper feed means and the surfaces A and B of the original carriage related together but, of course, the invention is equally applicable to the conventional copying machines in which the original supporting surface is used without distinction between the front-and the back-face copying. In such cases, the front and back faces of an original may be copied by relocating the original.

First Feed Means

The first paper feed means in FIG. 31 will now be described in greater detail.

Figure 38:
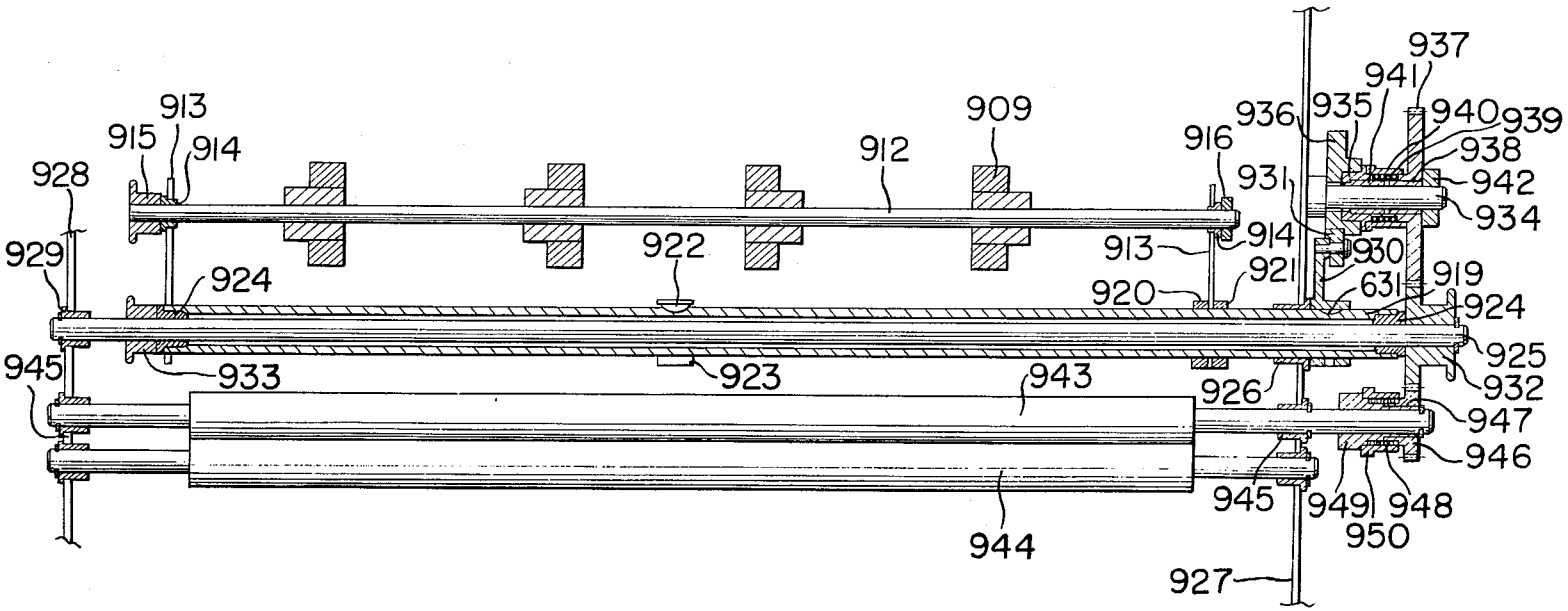
FIG. 38 is a cross-sectional view illustrating the construction and operation of first feed means.
Figure 39:
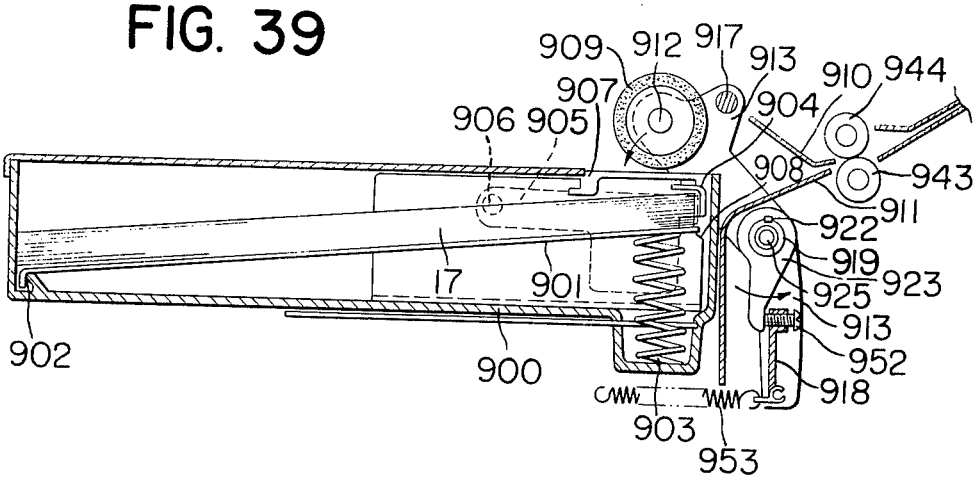
FIG. 39 is a cross-sectional side view of the first feed means.
Figure 40:
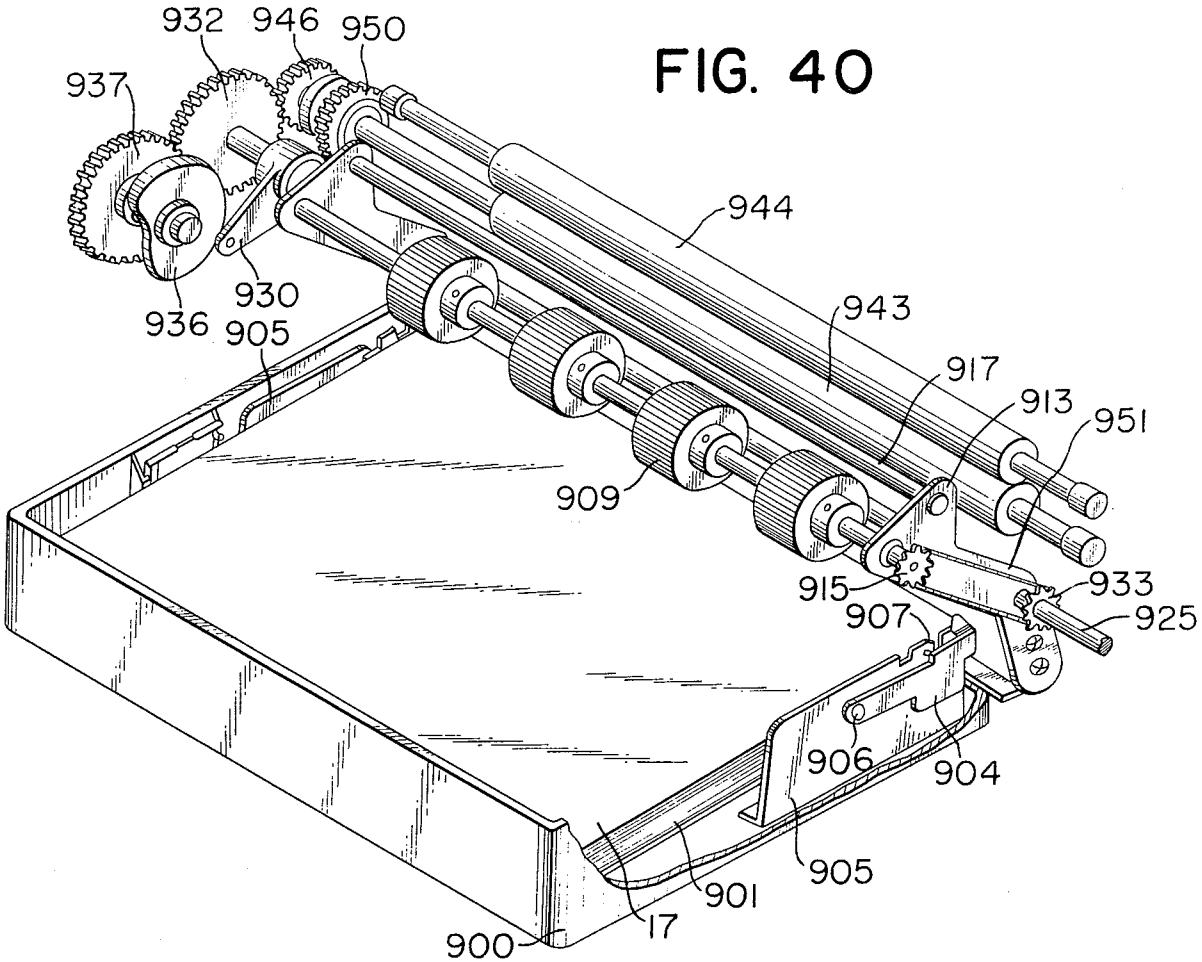
FIG. 40 is a perspective view of the first feed means.

FIG. 40 is a perspective view of the first paper feed means in the present embodiment, FIG. 39 is a cross-sectional front view of the feed means, and FIG. 38 illustrates the driving method for the paper feed.

In the present embodiment, the first paper feed means comprises a cassette and feed rollers, and the construction and operation thereof will fully be described by reference to FIGS. 38 to 40.

Reference numeral 900 designates a cassette in which an intermediate plate 901 for supporting thereon sheets of copy paper 17 is pivotable about a pivot 902 and normally biased upwardly by a spring 903 so that the forward end of the copy paper 17 on the intermediate plate 901 is urged against a separator pawls 904.

The separator pawls 904 are each mounted on a separator pawl mounting plate 905 for pivotal movement about a shaft 906, and the upper and lower limits of the movement of each separator pawl 904 is defined by stops 907 and 908 provided on the separator pawl mounting plate 905, in such a manner that when the intermediate plate 901 is lowered against the force of the spring 903, each pawl pivot downwardly from gravity until it is stopped by a stop 908, and when the intermediate plate 901 is raised, each pawl 904 is also pivoted upwardly with the plate 901 until stopped by a stop 907.

The positions of the stops 907 and 908 are so set that the separator pawl may take a suitable position. For example, as the copy paper feed means to be described forces the copy paper 17 downwardly, the separator pawl 904 also lower from gravity while keeping contact with the copy paper 17, thereby causing the sheets of copy paper 17 to be separated and fed one by one.

In such feeding position, it is ensured that the separator pawl 904 always make contact with the top of the copy paper 17 from gravity and the stops make no interference.

Describing the feed means, feed rollers 909 are provided to feed the copy paper 17 from the cassette into between paper guides 910 and 911.

The feed rollers 909 are securely mounted on a shaft 912 which is rotatably journalled to a pair of feed shaft mounting plates 913 by means of bearings 914 (FIG. 38). A ladder wheel 915 is secured to one end of the shaft 912 and a stop 916 for preventing slip-off of the shaft 912 is secured to the other end of the shaft 912. The pair of feed shaft mounting plates 913 are fixed by stays 917 and 918.

Designated by 919 is a hollow shaft, about which the feed shaft mounting plate 913 is pivotally mounted, and stops 920 and 921 for preventing lateral offset of copy paper are secured to the hollow shaft. A block 923 is secured to the hollow shaft 919 by means of a woodruff key 922. The hollow shaft 919 is rotatable relative to a rotatable shaft 925 with a bearing 924 interposed therebetween. The hollow shaft 919 is also rotatable relative to the rear side plate 927 of the copying machine body with a bearing 926 interposed therebetween. The rotatable shaft 925 is rotatably journalled to the front side plate 928 of the machine body by means of a bearing 929. A cam follower arm 930 is secured to the hollow shaft 919 by means of a woodruff key 631, and a cam follower 931 is rotatably mounted on a shaft secured to the cam follower cam 930.

A driving gear 932, which comprises a gear integral with a sprocket, is securely mounted on the rotatable shaft 925, and a ladder wheel 933 is also securely mounted on the rotatable shaft 925. A paper feed cam shaft 934 is secured to the rear side plate 927 of the machine body, and a clutch spring socket 935 secured to a bearing 941 and a paper feed cam 936 secured to the clutch spring socket 935 are rotatably mounted on the paper feed cam shaft 934.

A paper feed cam driving gear 937 is in meshing engagement with the driving gear 932 and secured to a bearing 938 rotatable relative to the paper feed cam shaft 934. A spring clutch 939 is engaged with the clutch spring socket 935 and with the paper feed cam driving gear 937, and a portion of a spring clutch 939 is engaged with a central ring 940. By extraneously restraining the control ring, the transmission of the rotation from the paper feed cam driving gear 937 to the paper feed cam 935 is cut off, but whenever no extraneous restraint is imparted to the control ring, the rotation of the paper feed cam driving gear 937 is transmitted to the paper feed cam 935 through the spring clutch 939. An anti-slip member 942 is secured to the paper feed cam shaft 934. Designated by 943 is a register driving roller and 944 a follower roller.

The register driving roller 943 is rotatable by means of a bearing 945 secured to a side plate of the machine body, and a register roller driving gear 946 meshing with the driving gear 932 is rotatably mounted on the register driving roller 943, with a bearing 947 interposed therebetween. A spring clutch 948 is engaged with the register roller driving gear 946 and with a clutch spring fitting 949 secured to the register driving roller 943. A portion of the spring clutch 948 is engaged with a control ring 950. When the control ring 950 is extraneously restrained, the rotative drive transmitted from the driving gear 932 to the register roller driving gear is not transmitted to the register driving roller 943. However, whenever no extraneous restraint is imparted to the control ring 950, the rotative drive transmitted from the driving gear 932 to the register roller driving gear 946 is transmitted to the fitting 949 through the spring clutch 948, thus rotating the register driving roller.

Description will now be made of the manner in which the sheets of copy paper are fed from within the cassette.

Normally, the driving gear 932 is rotatively driven from a drive source (not shown). Thus, the feed rollers 909 are rotated through the agency of the rotatable shaft 925 and the ladder wheel 915 is also rotated through the agency of the ladder wheel 933 and ladder chain 951.

However, such rotative drive is cut off to the paper feed cam 936 and the register roller 943 because the control rings 940 and 950 are restrained by extraneous means (such as solenoid or the like).

Next, at a point of time for paper feed, the control ring 940 is liberated from the extraneous restraint to thereby permit the paper feed cam 936 to start rotating, whereupon the paper feed cam follower 930 is rocked due to the circumferential outline of the paper feed cam 936 so that the block 923 is pivoted in the direction as indicated by arrow in FIG. 39, thus rocking the feed roller mounting plate 913 which is normally tensioned in one direction by a spring 953 through a screw 952 secured to the stay 918. By this, the feed roller 909 is also lowered in the direction as indicated by arrow in FIG. 39 to separate a sheet of copy paper from the paper feed stock in the cassette and feed it into between the feed guides 910 and 911. When the paper feed cam 936 makes one complete rotation, the control ring 940 is restrained by extraneous restraining means so that the paper feed cam is stopped.

On the other hand, the leading end edge of the copy paper 17 separated and fed into between the feed guides 910 and 911 strikes against the register rollers 943 and 944. These register rollers serve to provide for such timing that the copy paper 17 makes intimate contact with the drum 1 with the leading end edge of the copy paper registered to the leading end edge of the image on the drum. Thus, when such timing is gained, the register rollers so far stopped from rotating start to rotate with the control ring 950 thereof liberated from the restraint by the extraneous restraining means, thereby feeding the copy paper to the drum.

In the manner described above, sheets of copy paper 17 are fed one by one from the cassette to the drum 1.

Also, the function of the register rollers 943 and 944 may be taken over by the register rollers 29, as already explained in connection with FIG. 31. More specifically, the function of the register rollers which register the leading end edge of the copy paper to the leading end edge of the image on the drum may be imposed upon any suitable rollers situated in the paper feed passageway.

Figure 35:
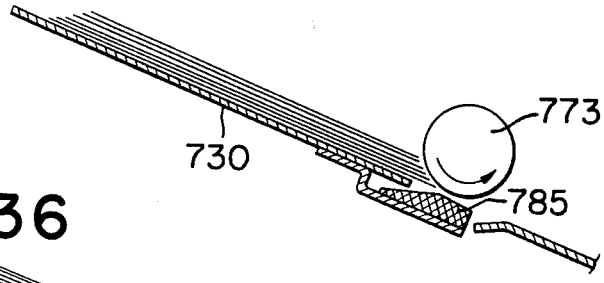
FIGS. 35 and 36 illustrate the operation of a separator-feeder roller during back-face copying.

The example shown in FIG. 35 employes, instead of the separator-feeder roller 774 shown in FIGS. 31, 32 and 34, a stationary member 785 installed so as to provide a moderate clearance with respect to the feed roller 773. This stationary member has a moderate friction coefficient and a plurality of such members may be installed. Again by the use of such stationary member or members, sheets of copy paper for back-face copying may be piled on the paper feed plate 730 during the front-face copying course, and may be separated one by one during the subsequent back-face copying and transported to the conveyor rollers 28 and register rollers 29.

Figure 36:
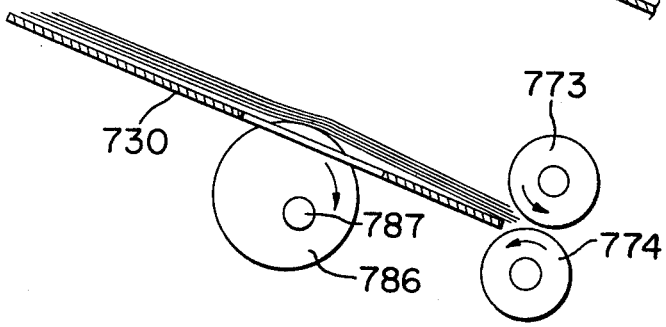

The relocating means for copy paper may also be designed as shown in FIG. 36, wherein a roller 786 (or cam-like member) is eccentrically mounted with respect to a shaft 787 and rotatable to intermittently squeeze the copy paper.

The invention has hitherto been described with the first and the second paper feed means and the surfaces A and B of the original carriage related together but, of course, the invention is equally applicable to the conventional copying machines in which the original supporting surface is used without distinction between the fron- and the back-face copying. In such case, the front and back faces of an original may be copied by relocating the original.

The copy paper used may conveniently include sheet-like members such as transparent paper and offset master paper.

In the present embodiment, the second paper feed means 750 is provided with a stop plate 770, but such stop plate 770 may be eliminated and there will be no inconvenience if the sheets of copy paper piled in the second paper feed means 750 are held in direct abuttment with the paper feed rollers 773 and 774. In this latter case, however, the paper feed roller 773 must be stopped from rotating at least during the front-face copying course.

Figure 37:
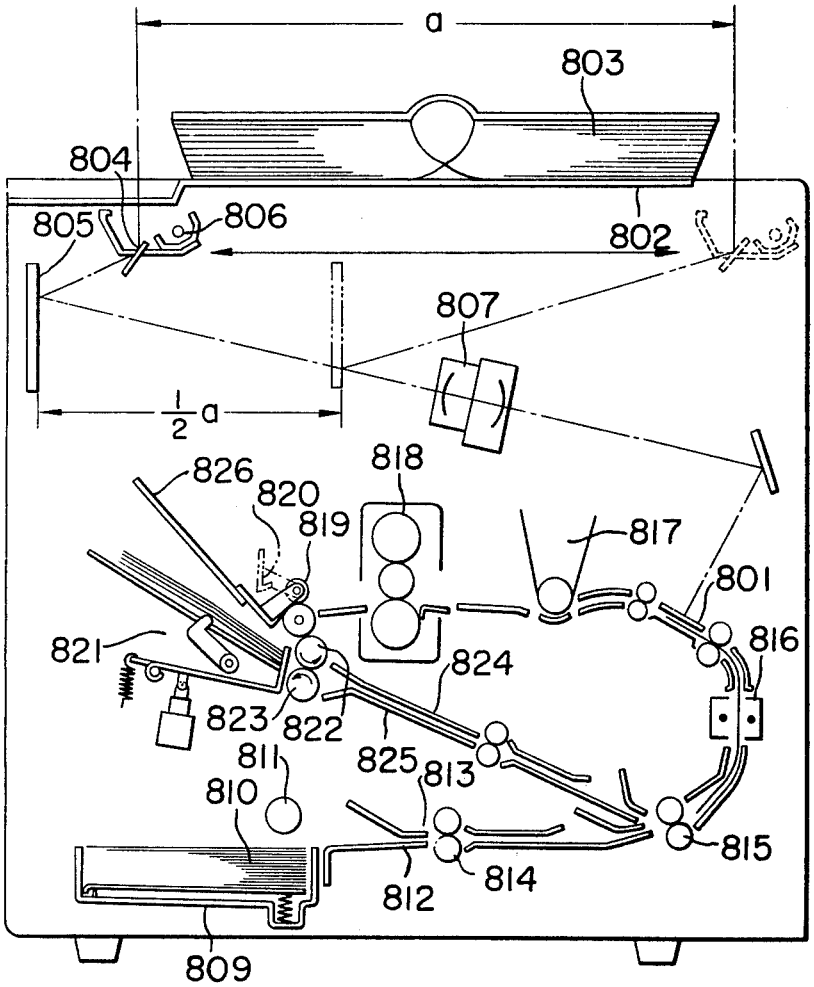
FIG. 37 is a vertical cross-sectional view showing another form of the third embodiment.

If the both-face copying mechanism according to the present invention is incorporated in the electrofax system which utilizes sheet-like members having the opposite faces thereof coated with photosensitive material such as zinc oxide or the like, there may be provided an embodiment as shown in FIG. 37, for example.

Referring to FIG. 37, an original 803 rests on the transparent plate 802 of the original carriage, and the optical system comprises movable mirrors 804, 805, a lens 807 and a stationary mirror. Designated by 806 is a movable illuminating lamp. The original 803 may be illuminated by the movable illuminating lamp 806 with the length of the optical path maintained constant by the movable mirror 804 moved with the lamp 806 and the movable mirror 805 moved in the same direction as but at half the speed of the mirror 804, and the image of the original may further be directed via the lens 807 and stationary mirror 808 and thrown upon an exposure surface 801 through a slit. The construction of this optical system so far described is identical with that shown in FIG. 31, with the exception that only one stationary mirror is employed.

On the other hand, the sheets of sensitive paper 810 piled in the first paper feed means may be fed one by one between paper feed guides 812 and 813 by the action of paper feed roller 811 and further into a charger 816 by transport rollers 814, 815. There, the sensitive paper may be electrostatically charged, and then in the exposure station 801, may be exposed to the original image through the slit and developed by the developing device 817. The developing device shown employs the magne-dry developing method. The sensitive paper may further pass through a fixing device 818 for the fixation of the toner image thereon. This fixing means is of the roller type which is similar to that shown in FIG. 1. The sensitive paper with the image fixed thereon may be discharged outwardly by discharge rollers. The member designated by 820 corresponds to the rocking member 752 shown in FIG. 31, and 821 designates second paper feed means corresponding to the second paper feed means 750 in FIG. 31. Rollers designated by 822 and 823 correspond to the paper feed rollers 773 and 774 shown in FIG. 31.

In the front-face copying course, the sensitive paper fed from the first paper feed means is transported between the paper feed guides 812 and 813 by the paper feed roller 811. The paper is further directed into the charger 816 by transport rollers 814, 815, subjected to exposure at 801, developed at 817, subjected to image fixation at 818, and conveyed by the discharge rollers 819 into the second paper feed means 821. Subsequently, in the back-face copying course, the sensitive paper is introduced between the paper guides 824 and 825 by feed rollers 822, 823, and further directed to the charger 816 by transport rollers 815, whereafter the sensitive paper is subjected to the same process as that described with respect to the front-face copying course, and finally discharged onto a tray 826 by discharged rollers 819.

AUTOMATIC ORIGINAL SUPPLY MEANS

In each embodiment of the copying machine capable of both-face copying, there may be obtained various advantages by providing an automatic original supply means, for example, effecting the both-face copying with sheet originals arranged in the order of page numbers and by the use of the both-face copying machine of the construction now under discussion. One of the advantages is that the sheets of copy paper having completed the both-face copying are piled on the tray 30 also in the order of page numbers. Describing the automatic original supply means shown in FIG. 24, it is provided with a sheet original transport section chiefly comprising sheet original transport rollers 632, 633, 634 and 635, and the entire original carriage is displaced, for example, from the position of FIG. 16 in which the original carriage of the stationary type is used for the copying of thick originals, to the position of FIG. 24 which is for the copying of sheet originals.

At the same time, the illuminating section is displaced to a position right beneath the sheet original transport section. The original carriage 631 is provided with a wheel 640 so that it is manually easily movable on a rail 641 secured to the machine body, to the right and left as viewed in FIG. 16, and it is also lockable at said two positions.

When a pile of sheet originals 650 is placed on a sheet original insertion bed 651, the uppermost original 650' is transported to the sheet original transport section by separatorfeeder rollers 654 and 655.

Figure 25:
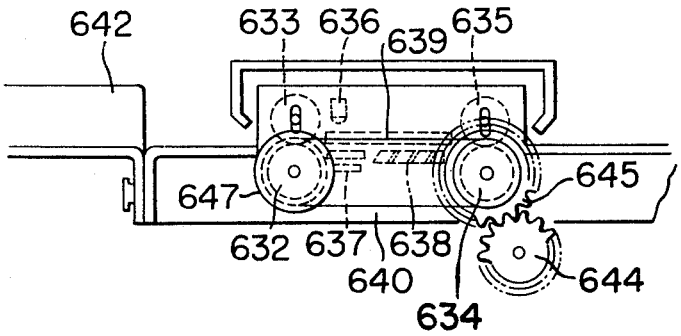
FIG. 25 is a cross-sectional view of the control portion therefor.

Thereupon, the image of the original is focused on the drum 1 in the same manner as in the usual sheet original copying, whereafter the original 650' is discharged into an original discharge tray 659 by a guide 656 and delivery rollers 657, 658. Now, describing the sheet original transport section, a sheet original is transported between transport rollers 632 and 633 and has the leading end thereof detected by a lamp 636 and a light-sensing element 637, whereupon the sheet original is temporally stopped. When the drum 1 is rotated to a predetermined position, the sheet original is again transported between a guide glass 638 and a guide plate 639 by transport rollers 632, 633, 634, 635 while keeping synchronism with the drum 1, on which the image of the original is focused. When the original carriage 631 is displaced to its position for the copying of sheet originals, a gear 645 mounted on the transport roller 634 comes into meshing engagement with the driving gear 644 on the machine body to thereby drive the transport roller 634 and also drive the transport roller 632 through a belt or chain 646 and an electromagnetic clutch 647. The electromagnetic clutch 647 is controlled by a signal produced from the light-sensing element 637 and from the rotational position of the drum (see FIG. 25).

It is assumed that, by utilizing such an automatic original supply means, sheet originals having images on the opposite faces thereof and arranged in the order of page numbers are placed on the sheet original insertion bed 651 for the surface-A copying process. For the simplicity of description, assume that there are five sheet originals each printed on the opposited faces thereof, thus forming ten pages in all. These originals are placed on the sheet original insertion bed 651 with the first page at the top, then the five originals will be piled on the original discharge tray with the first page at the bottom and with the odd-numbered pages facing downwardly, at the end of the surface-A copying course.

Figure 24:
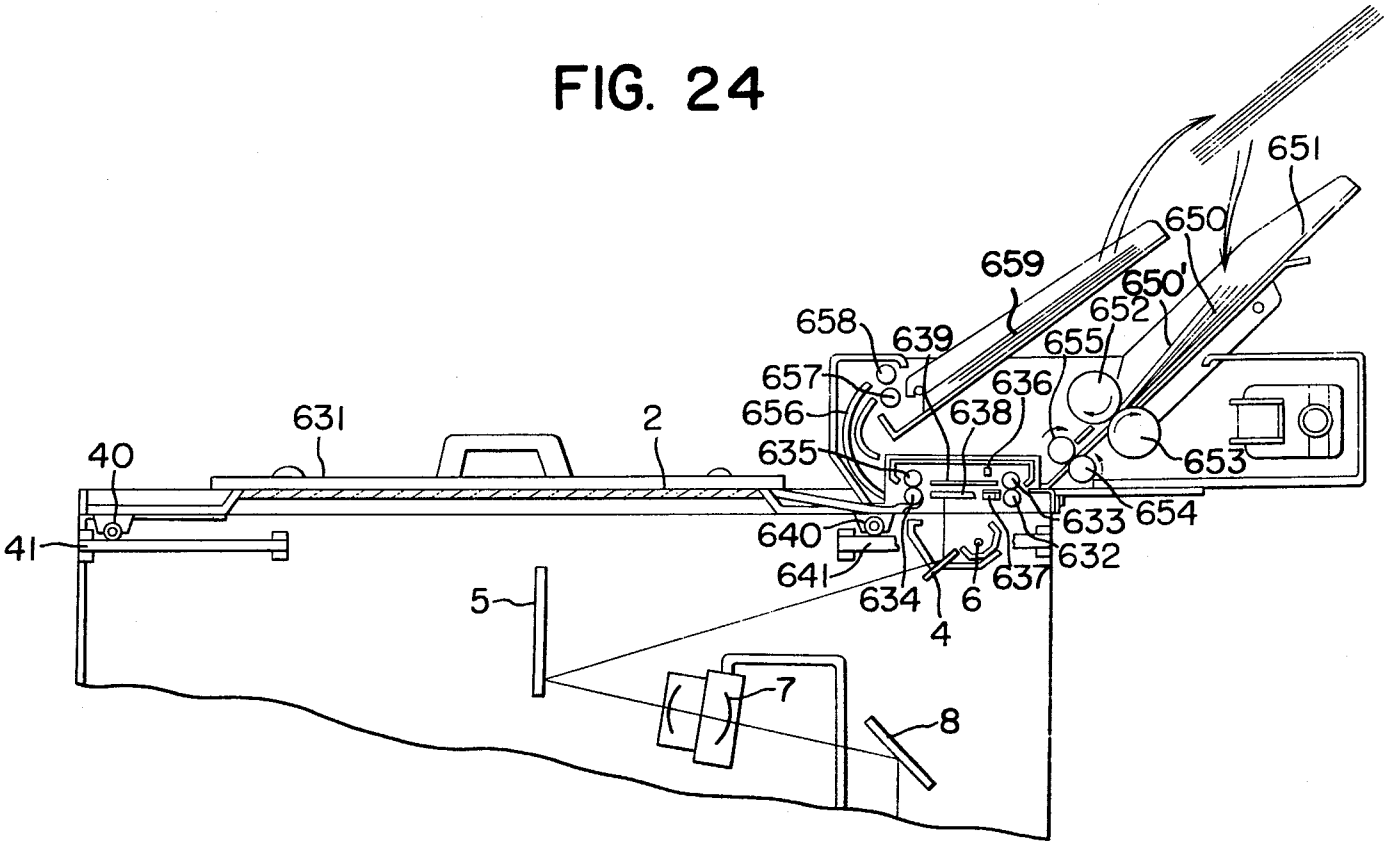
FIG. 24 is a cross-sectional view of an automatic original supply means in each embodiment.

At this time, in the surface-B copying paper feed stock section, copy sheets having already copied the second, the fourth . . . ., the eighth and the tenth pages are piled with their printed faces turned upwardly in preparation for the surface-B copying. Before the surface-B copying course is entered, the originals are removed from the original discharge tray without changing their order and orientation, in the manner as shown in FIG. 24, and then placed onto the sheet original insertion bed 651, whereby during the surface-B copying course, the ninth page of the sheet originals is first copied on the back face of the tenth page of the copy sheets for back-face copying and that copy sheet is discharged into the tray with the ninth page facing upwardly, whereafter the seventh page is copied on the back face of the eighth page of the copy sheets and that copy sheet is likewise discharged with the seventh page facing upwardly and finally, the first page of the sheet originals is copied on the back face of the second page of the copy sheets and that copy sheet is likewise discharged with the first page facing upwardly.

Likewise, on the part of the original discharge tray, an original is first discharged with the ninth page facing upwardly and the other four sheet originals are successively discharged in a similar manner, the last discharged original thus being positioned in the original discharge tray with the first page facing upwardly.

Thus, if both-face printed originals piled in the order of page numbers are subjected to the both-face copying, both-face printed copy sheets are also discharged into the tray in the order of their page numbers while the originals are also discharged and piled on the tray in the order of their page number.

What is claimed is:

1. A copying machine comprising:
a photosensitive member;
means for applying an electrostatic charge to said photosensitive member;
an optical system for projecting an original image onto said photosensitive member to form an electrostatic latent image of the original image;
means for developing the electrostatic latent image to form a developed image;
means for transferring the developed image to a copy material;
first feeding means for feeding a copy material toward and past the transferring means, wherein a first end thereof constitutes the leading end during movement thereof by said first feeding means;
means for reversing the copy material fed by said first feeding means, after the developed image is transferred onto a first side of the copy material to move the copy material with its opposite end as the leading end;
means for engaging the said opposite end of the copy material after it is reversed, to stop the copy material and to allow it to be stacked; and
second feeding means for feeding the said stacked copy material to the transferring means with said opposite end thereof as the leading end.

2. A machine according to claim 1, wherein said stopping means is located in a copy material passageway between the transferring means and the reversing means.

3. A machine according to claim 2, wherein said stopping means includes a cassette removably mounted in the passageway.

4. A machine according to claim 2, further comprising means, disposed in the passageway, for arranging the copy material in order.

5. A machine according to claim 2, further comprising means, disposed in the passageway, for preventing laterial disalignment of the copy material.

6. A machine according to claim 1, wherein said second feeding means includes two rollers rotatable in the same rotational direction.

7. A machine according to claim 6, including means for stopping rotation of the rollers to stop movement of the copy material.

8. A machine according to claim 1, further comprising a discharged copy material accommodating station disposed adjacent said stopping means.

9. A machine according to claim 1, wherein said reversing means includes a changeover lever and a reversible pair of rollers.

10. A copying machine comprising:
an original holder having a holding surface for simultaneously holding for exposure a first original for a first side copy and, adjacent thereto, a second original for a second side copy onto copy material;
a photosensitive member;
means for applying an electrostatic charge to said photosensitive member;
an optical system for projecting images of the first and second originals onto said photosensitive member to form electrostatic latent images thereof;
means for developing the electrostatic latent images to form respective developed images;
means for transferring the developed images to a copy material;
first feeding means for feeding a copy material toward and past the transferring means with a first end thereof constituting a leading end during movement thereof by said first feeding means, wherein the developed image corresponding to said first original is transferred onto a first side of a copy material;
means for reversing the copy material fed by said first feeding means after the developed image is transferred onto a first side of the copy material, to move the copy material with its opposite end as a leading end;
means for engaging the said opposite end of the copy material after it is reversed, to stop the copy material and to allow it to be stacked; and
second feeding means for feeding the said stacked copy material to the transferring means with said opposite end thereof as the leading end wherein developed image corresponding to the second original is transferred onto the said second side of a copy material to receive the developed image corresponding to the original for the second copy.

11. A copying machine according to claim 10, wherein a boundary on said photosensitive member between surfaces for the first side copy and the second side copy is changeable.

12. A copying machine according to claim 11, wherein a display is provided correspondingly to the boundary.

13. A copying machine comprising:
an automatic original feeder for successively transporting plural sheet originals and discharging them in a reversed state, and for then transporting them and discharging them in an original state;
a photosensitive member;
means for applying an electrostatic charge to said photosensitive member;
an optical system for projecting images of said originals onto said photosensitive member to form electrostatic latent images thereof;
means for developing the electrostatic latent images to form developed images;
means for transferring the developed images to sheets of copy material;
first feeding means for feeding copy sheets toward and past the transferring means with a first end of each said sheet constituting a leading end during movement thereof by said first feeding means for successively transferring said developed images onto successive copy sheets;
means for reversing the copy sheets fed by said first feeding means after developed images are transferred onto first sides thereof, and to move the copy sheets with their opposite ends as leading ends;

means for engaging the copy sheets conveyed from said reversing means and to stack the copy sheets; and second feeding means for feeding the said stacked copy sheet in the order corresponding to the originals which are fed after discharge by said automatic feeder in the reversed state.

14. A machine according to claim 13, wherein said automatic original feeding means feeds a topmost original of the originals placed in a stack, and said second feeding means feeds a topmost copy sheet of the said stacked copy materials.

15. A machine according to claim 13, further comprising means for collecting said originals when they are discharged in their original state.

* * * * *

UNITED STATES PATENT OFFICE

CERTIFICATE OF CORRECTION

Patent No. 4,098,551 Dated July 4, 1978

Inventor(s) SHIGEHIRO KOMORI, et al.

It is certified that error appears in the above-identified patent and that said Letters Patent are hereby corrected as shown below:

| | |
|---|---|
| Column 2, line 4 | Change "alsio" to --also--. |
| Column 4, line 67 | Change "Fig. 53" to --Fig. 23--. |
| Column 7, line 54 | Change "meamns" to --means--. |
| Column 13, line 10 | Change "(not showwn)" to --(not shown)--. |
| Column 18, line 32 | Change "In such as case" to --In such a case--. |
| Column 19, line 22 | Change "surface-a" to --surface-A--. |
| Column 21, line 46 | Change "of" to --or--. |
| Column 26, line 11 | Change "separatorfeeder" to --separator-feeder--. |

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*